US005915319A

United States Patent [19]

Price et al.

[11] Patent Number: 5,915,319

[45] Date of Patent: Jun. 29, 1999

[54] METHOD AND APPARATUS FOR PRODUCING A HEMMED, FOLDED, AND SEAMED FINISHED WORKPIECE

[75] Inventors: Elvin C. Price, Dacula; Preston B. Dasher, Lawrenceville; Tadeusz Olewicz, Hoschton; George Price, Lawrenceville, all of Ga.

[73] Assignee: Atlanta Attachment Company, Lawrenceville, Ga.

[21] Appl. No.: 09/045,759

[22] Filed: Mar. 20, 1998

Related U.S. Application Data

[63] Continuation-in-part of application No. 08/915,533, Aug. 15, 1997, Pat. No. 5,865,135.

[51] Int. Cl.[6] ..... D05B 21/00; D05B 35/04

[52] U.S. Cl. ..... 112/470.16; 112/141; 112/147; 112/475.06; 493/418

[58] Field of Search ..... 112/470.16, 470.05, 112/470.06, 470.07, 470.09, 470.36, 475.06, 141, 147, DIG. 2, DIG. 3; 493/418, 450, 405, 937; 270/32, 45

[56] References Cited

U.S. PATENT DOCUMENTS

| | | | |
|---|---|---|---|
| 2,861,801 | 11/1958 | Cran | 270/68 |
| 3,094,321 | 6/1963 | Kamberg | 270/68 |
| 3,260,518 | 7/1966 | Kamberg et al. | 270/62 |
| 3,554,354 | 1/1971 | Reid et al. | 198/33 |
| 3,824,964 | 7/1974 | Ryan | 223/30 |
| 3,970,014 | 7/1976 | Chano et al. | 112/121 |
| 4,046,087 | 9/1977 | Manetti | 112/121 |
| 4,053,967 | 10/1977 | Mair | 26/98 |
| 4,061,327 | 12/1977 | Blessing | 270/78 |
| 4,098,201 | 7/1978 | Adamski, Jr. et al. | 112/2 |
| 4,265,187 | 5/1981 | Torre | 112/121 |
| 4,343,255 | 8/1982 | Kelly et al. | 112/262 |
| 4,428,315 | 1/1984 | Keeton | 112/262 |
| 4,460,350 | 7/1984 | Mittal et al. | 493/412 |
| 4,473,017 | 9/1984 | Letard et al. | 112/141 |
| 4,484,532 | 11/1984 | Norz | 112/2 |
| 4,526,115 | 7/1985 | Kosrow et al. | 112/262 |
| 4,528,922 | 7/1985 | Adamski et al. | 112/262 |
| 4,530,295 | 7/1985 | Adamski et al. | 112/121 |
| 4,531,721 | 7/1985 | Kosrow | 270/45 |
| 4,587,913 | 5/1986 | Yin et al. | 112/262 |
| 4,681,051 | 7/1987 | Kirch et al. | 112/306 |
| 4,784,381 | 11/1988 | Prochut et al. | 271/268 |
| 4,800,830 | 1/1989 | Adamski et al. | 112/303 |
| 4,819,926 | 4/1989 | Kosrow et al. | 270/45 |
| 4,858,546 | 8/1989 | Adamski et al. | 112/286 |
| 4,896,619 | 1/1990 | Adamski et al. | 112/306 |

(List continued on next page.)

FOREIGN PATENT DOCUMENTS 58-11471 1/1983 Japan .

*Primary Examiner*—Peter Nerbun

*Attorney, Agent, or Firm*—Womble Carlyle Sandridge & Rice

[57] ABSTRACT

A hemming and seaming machine (5) having a hemming conveyor (16) on which a workpiece is moved along a path of travel toward and through a hemming station which sews a hem in the workpiece is disclosed. The hemmed workpiece is then moved downstream to a folding station (25) where a spaced series of first air jets (61) selectively emit streams of air between a folding plate (26) and clamping plate (55) to create a vacuum therebetween to draw the leading edge of the workpiece off of the hemming conveyor and between the folding plate and the clamping plate. The leading edge of the workpiece is held between the clamping and folding plates while the workpiece continues to move along the path of travel. After a predetermined period of time has elapsed from the detection of the leading edge of the workpiece, or in response to the detection of the trailing edge of the workpiece, the leading edge of the workpiece is released from between the folding and clamping plates. The workpiece is then moved to a downstream seamer station (175), which sews a seam in the workpiece, and then to a downstream workpiece stacking station (177).

23 Claims, 10 Drawing Sheets

U.S. PATENT DOCUMENTS

| | | | |
|---|---|---|---|
| 4,911,092 | 3/1990 | Adamski, Jr. et al. | 112/121 |
| 4,922,842 | 5/1990 | Adamski et al. | 112/304 |
| 4,928,610 | 5/1990 | Akutsu | 112/153 |
| 4,972,787 | 11/1990 | Adamski et al. | 112/308 |
| 5,108,017 | 4/1992 | Adamski, Jr. et al. | 223/37 |
| 5,152,235 | 10/1992 | Goto et al. | 112/63 |
| 5,159,874 | 11/1992 | Adamski, Jr. et al. | 112/262 |
| 5,188,047 | 2/1993 | Rohr et al. | 112/262 |
| 5,226,378 | 7/1993 | Suzuki et al. | 112/121 |
| 5,251,557 | 10/1993 | Rohr | 112/306 |
| 5,269,239 | 12/1993 | Adamski, Jr. et al. | 112/121 |
| 5,269,257 | 12/1993 | Yamazaki | 112/262 |
| 5,373,797 | 12/1994 | Bottoms et al. | 112/475.06 X |
| 5,437,238 | 8/1995 | Price et al. | 112/470 |
| 5,454,336 | 10/1995 | Iwasaki | 112/470.16 |
| 5,524,563 | 6/1996 | Huddleston | 112/141 |
| 5,562,060 | 10/1996 | Price et al. | 112/470 |
| 5,570,647 | 11/1996 | Adamski, Jr. et al. | 112/470 |
| 5,657,711 | 8/1997 | Price et al. | 112/470 |

METHOD AND APPARATUS FOR PRODUCING A HEMMED, FOLDED, AND SEAMED FINISHED WORKPIECE

CROSS-REFERENCE TO RELATED APPLICATION

This application is a continuation-in-part application of U.S. patent application Ser. No. 08/915,533 filed Aug. 15, 1997, now U.S. Pat. No. 5,865,135.

FIELD OF THE INVENTION

This invention relates to a method and apparatus for producing a hemmed, folded, and seamed cloth or textile workpiece on an automated hemming and seaming machine. More particularly, a workpiece is passed through a series of work stations positioned along a sewing path, which automatically hem a first edge of the workpiece, fold the workpiece, and align the leading and trailing edges of the workpiece, after which the leading and trailing edges of the workpiece are seamed together, and the finished workpieces are stacked in preparation for further processing.

BACKGROUND OF THE INVENTION

In the production of garments in an industrial setting, batches of workpieces, for example cloth blanks, are processed through separate work stations for being formed into finished workpieces such as shirt sleeves. The finished workpieces are then conveyed to another work station, or work stations, for being combined into the finished item of clothing. For example, it is common for the sleeves of a shirt to be produced at a first work station, typically a hemming and seaming machine, with the body of the shirt being bottom hemmed, the neck finished, and a waistband added if necessary at additional work stations, and thereafter the body and the sleeves of the shirt are sewn together at a final work station to form the finished garment.

The production of these garments is typically accomplished in high volume, high speed operations in which consistent size and quality of the finished workpieces are required in order to arrive at consistently sized and finished items of clothing at the end of the fabrication process. One problem in working with textile workpieces, however, is that they tend to have a natural elasticity that is typically exhibited during handling, such that wrinkles or undesired curls or folds may occur in the leading edge, trailing edge, or in the body of the workpiece as it is being processed. If these curls or folds are not removed from the workpiece during fabrication, the finished workpiece may be poorly formed, or formed with defects. In addition, consistency in the sewing, hemming, and folding of the workpieces with their seams and hems aligned, and edges matched for folding is critical to ensure that quality is maintained and that the workpieces are not formed with inconsistencies in appearance and size so as to require resewing or discarding of these workpieces. Maintaining such consistency thus requires a high degree of precision in seaming, hemming, and folding of the workpieces, typically at a reduced production rate.

For example, during the production of shirt sleeves, a workpiece blank having a leading edge, a trailing edge, and a first straight side edge extending between the leading edge and the trailing edge is placed on a hemming machine. Thereafter, a hem is sewn in the first straight side edge of the workpiece as the workpiece is moved, leading edge first, along a conveyor and through a hemming station. To form the finished tubular sleeve, the workpiece then must be folded such that the top portion of the hem is aligned with the bottom portion of the hem, and the leading edge is aligned with the trailing edge, if so desired. In the alternative, the workpiece can be folded to a preset size, with any excess leading or trailing edge material needing to be cut off prior to the two edges being sewn together in a seam.

It is during this folding process that unwanted curls often tend to form in the edges of the sleeve, which can disrupt the seam. Also, it is important for the edges to be properly aligned prior to seaming to avoid waste of material and to ensure consistency of size of the finished sleeves. If the edges are not properly aligned before seaming, the finished sleeves can be formed too small or too large to match the shirt sleeve openings of the shirt bodies. As a result, the sleeve or the material of the shirt bodies about these sleeve openings tends to become bunched or puckered due to the elasticity of the cloth of the sleeve and/or body, which must be stretched to match the sleeve openings for sewing. In addition, most hemming and seaming systems are not able to accommodate a wide range of sizes of sleeves such that variations in sizes of the sleeve blanks require an adjustment or recalibration of the machine to seam and hem different size workpieces.

An example of a conventional cloth folding and sewing device designed to remove the curl formed in the leading edge of the workpiece during the folding process, is disclosed in U.S. Pat. Nos. 5,363,784, and 5,197,722, issued to Adamski, Jr., et al. on Nov. 15, 1994, and Mar. 30, 1993, respectively. In the device of the two Adamski, Jr., et al. patents, a workpiece is moved along a path of travel on a conveyor belt toward a sleeve handling (folding) device. Once in the appropriate position, as determined by a sensor, an elongate sleeve pickup blade is moved upwardly from a position beneath the workpiece and engages the underside of the workpiece to drive a leading edge portion upwardly into a pair of spaced jaws formed as a part of a pickup assembly. Thereafter, the leading edge portion of the workpiece, but not the leading edge itself, is held by the jaws as the remainder of the workpiece continues to move along the path of travel on the conveyor to fold the workpiece. To assist in folding the workpiece, a blower is directed in the direction of the path of travel and against the workpiece. Once the workpiece has been folded to the desired size, the jaws release the leading edge portion of the workpiece, but in doing so a fold or a curl is formed at the leading edge of the workpiece. A downstream air blower is thus required in order to direct a jet of air in the direction opposite the direction of movement of the workpiece and into engagement with the folded or curled upper portion of the workpiece to eliminate this fold or curl, all of which is required due to the fold or curl formed in the workpiece by the device of Adamski, Jr., et al. in the first instance. Thus, in order to perform its folding operation, the device of Adamski, Jr., et al. first creates an unwanted problem condition that it must then solve.

What is needed, therefore, is a method and apparatus which automatically, rapidly, and accurately hems, folds and seams workpieces but will not introduce any unwanted folds, curls, or wrinkles in the workpieces during the folding thereof to ensure high production rates with high quality. What is also needed, but seemingly unavailable in the art, is a device which not only can fold the workpiece, but can fold the workpiece to a desired size, or can consistently fold a workpiece in half, no matter the size of the workpiece and despite variances between workpieces without requiring recalibration of the apparatus to ensure consistency and quality in the production of hemmed/seamed workpieces at improved production rates.

SUMMARY OF THE INVENTION

The present invention provides an improved method and apparatus for hemming, folding, and seaming a cloth or textile blank to form a finished workpiece, for example a sleeve or a pant leg, of consistently uniform size and quality, and which overcomes some of the design deficiencies of other cloth handling and folding devices known in the art, including minimizing the problem of leading edge curls created during the folding of the workpiece. The present invention also actively aligns the top and bottom portions of the folded workpiece to ensure high quality and to accommodate variations in sizes of the workpieces. Thus, the present invention substantially reduces the formation of defects in the finished workpieces as the workpieces are being produced, which allows for greater workpiece production rates. Moreover, the relative simplicity and ease of use of this device, in comparison with known cloth handling and folding devices, allows for a higher degree of flexibility in that this construction is readily adapted for folding workpieces of a wide range of types and sizes, to yield consistently finished high quality workpieces without requiring adjustments or recalibration of the apparatus.

The hemmer/seamer machine of the present invention generally includes a U-shaped frame work on which a series of work stations are positioned for hemming, folding, seaming and stacking the workpieces. Each workpiece generally has a leading edge, a spaced trailing edge, and a continuous first side edge in which a hem is sewn as the workpiece is moved through a first work station at the start of a hemming/seaming operation. The first work station comprises a hemming station having a first detector, an elongate hemming conveyor extending along a first path of travel, a hemming folder along the conveyor, and a sewing head positioned along the path of travel at the downstream end of the hemming conveyor. As the workpiece is conveyed by the hemming conveyor, its first side edge is folded under by the hemming folder and a hem is sewn therein by the sewing head.

A second detector is mounted adjacent the sewing head for detecting the leading and trailing edges of the workpiece as they pass out of the hemming folder toward a downstream folding station for controlling the sewing head of the hemming station. The folding station includes a third detector positioned downstream of the sewing head, folding plate spaced above and parallel to the work table on which the hemming conveyor is supported, a separator blade mounted to the top of the folding plate along the downstream edge of the folding plate, and a clamping plate spaced above and parallel to the folding plate. A spaced series of air jets are mounted adjacent the downstream edge of the clamping plate and selectively emit streams or flows of air between the folding plate and the clamping plate in a direction opposite the path of travel of the workpiece. As a result, a venturi-effect air flow or vacuum is created between the folding and clamping plates which draws the leading edge of the workpiece upwardly between the folding plate and the clamping plate as the remainder of the workpiece continues to pass beneath the folding plate on the hemming conveyor. Once a leading edge portion of the workpiece has been drawn between the folding and clamping plates, the clamping plate is reciprocably moved into a lowered, clamped position in engagement with the folding plate for clamping the leading edge portion of the workpiece therebetween as a trailing portion of the workpiece is moved beneath the folding plate.

Once the workpiece has been clamped between the clamping and folding plates, the air jets of the clamping plate are deactivated, while at the same time pressurized air is supplied to a plenum mounted along a side edge of the folding plate. The folding plate is constructed from a pair of upper and lower plates mated together, with the lower plate having a pair of separated chambers that communicate with and receive the air flow from the plenum. Each chamber is further subdivided by a series of ribs defining channels extending toward and terminating in ports defined along the downstream side edge of the folding plate so as to evenly distribute the air flow received through the folding plate across the width of the workpiece. The air flow is introduced into the chambers of the folding plate as a high velocity, low volume air flow and is distributed through the chambers, channels, and ports so that it is exhausted from the folding plate as a low velocity, high volume air flow, or flows, directed at a mid-portion of the workpiece. These air flows act to separate the leading and trailing portions of the workpiece during the folding process and help to smoothly and uniformly roll out the lower, trailing portion of the workpiece for folding the workpiece in half.

Once the trailing edge of the workpiece is detected by the third detector, the air flow through the folding plate is deactivated while the air jets along the downstream edge of the clamping plate are reactivated. At the same time, the clamping plate is raised slightly to a partially open position to enable the upper or leading edge portion of the workpiece to be removed from between the folding and clamping plates as the workpiece progresses along the path of travel to complete the folding operation, while at the same time, aligned air jets direct air flows against the hemmed side edge of the workpiece to urge the side edge against a guide for aligning the hemmed side edge of the leading and trailing portions of the workpiece with one another.

As the leading edge portion of the workpiece is moved from between the folding and clamping plates, it passes over the separator blade mounted to the upper plate of the folding plate. The separator blade includes a beveled back edge that tends to catch any under-folds that may have been formed in the leading edge portion of the workpiece as the leading edge of the workpiece is drawn out from between the folding and clamping plates, and tends to cause such under-folds to be straightened out or removed as the leading edge portion is moved from between the clamping and folding plates so that the workpiece is accurately and completely folded without leaving any under-fold left therein prior to seaming the workpiece. Thereafter, the workpiece is moved out of the folding station as the air jets along the rear of the clamping plate are deactivated and the clamping plate is moved to its fully open position so as to release the leading edge portion of the workpiece, which is then generally aligned with and overlaid over the trailing edge of the workpiece.

Downstream of the folding station and the alignment device is a first transport clamp assembly which includes a movable transport clamp plate adapted to engage an upper portion of the folded workpiece and to slide the workpiece over a smooth surfaced transport table. The transport table may include a series of pressurized directional air jets mounted flush in the surface thereof for creating an air flotation cushion beneath a lower portion of the folded workpiece such that the workpiece can be easily slid across the surface of the transport table. The first transport clamp assembly engages the workpiece at a first position and moves the workpiece away from the folding station toward a second release position at a first rate of speed and then decelerates the workpiece to a second rate of speed to prevent the collapse of the workpiece or the formation of a curl or a lip in the leading edge of the upper portion of the workpiece caused by the inertia of the workpiece as it is brought to a stop by the first transport clamp assembly. The second, slower rate of speed of the first transport clamp assembly ensures that the leading and trailing edges of the workpiece remain in alignment with one another.

A second transport clamp assembly, including a hem clamp, is positioned adjacent the release position of the first transport clamp assembly, and includes a transport clamp vertically movable into engagement with the workpiece prior to its release by the first transport clamp, whereupon the first transport clamp assembly releases the workpiece. The second transport clamp assembly is movable in a direction normal to the path of the first transport clamp assembly, and moves the workpiece toward a downstream seamer station, partially rotating the workpiece, if necessary, to align the workpiece with the sewing head of the seamer station so that the appropriate seam may be formed in the workpiece.

A workpiece stacking station is positioned downstream of the seamer station, and includes a transfer plate onto which the finished workpiece is received as it moves out of the seamer station. A side conveyor is positioned at the distal end of the conveyor, adjacent a flip plate onto which the finished workpiece is placed by the side conveyor, positioned downstream of the transfer plate. The flip plate then places the finished workpiece in a bundle tray positioned adjacent the operator's station of the machine because of the U-shaped configuration of the machine, which has the effect of "returning" the now finished workpiece to the operator so the operator can quickly and easily visually inspect the finished workpieces without substantial disruption in the operation of the machine.

It is, therefore, an object of this invention to provide an improved method and apparatus for producing a hemmed, folded, and seamed finished workpiece without the formation of a fold, curl, or a lip in the leading edge of the folded workpiece during the folding process.

It is another object of the present invention to provide an improved method and apparatus for forming a hemmed, folded, and seamed finished workpiece which enables sleeves to be hemmed, folded and seamed reliably and efficiently to ensure that a high production rate of consistently finished workpieces is maintained.

Yet another object of the present invention is to provide an improved method and apparatus for producing hemmed, folded, and seamed finished workpieces that is simple in operation and design, is rugged and durable in structure and use, and which will ensure the production of consistently sized, quality finished workpieces.

It is still another object of this invention to provide an improved method and apparatus for folding textile articles of a wide range of sizes consistently and at high production rates without requiring recalibration of the apparatus for variations in sizes of the articles.

The present invention accomplishes these objects, among others, while providing for flexible, efficient, and continuous high speed automated hemming, folding, and seaming operations on cloth workpieces.

Other objects, features, and advantages of the present invention will become apparent, therefore, upon reading the following specification, when taken in conjunction with the accompanying drawings.

DETAILED DESCRIPTION OF THE PREFERRED EMBODIMENTS

Figure 1:
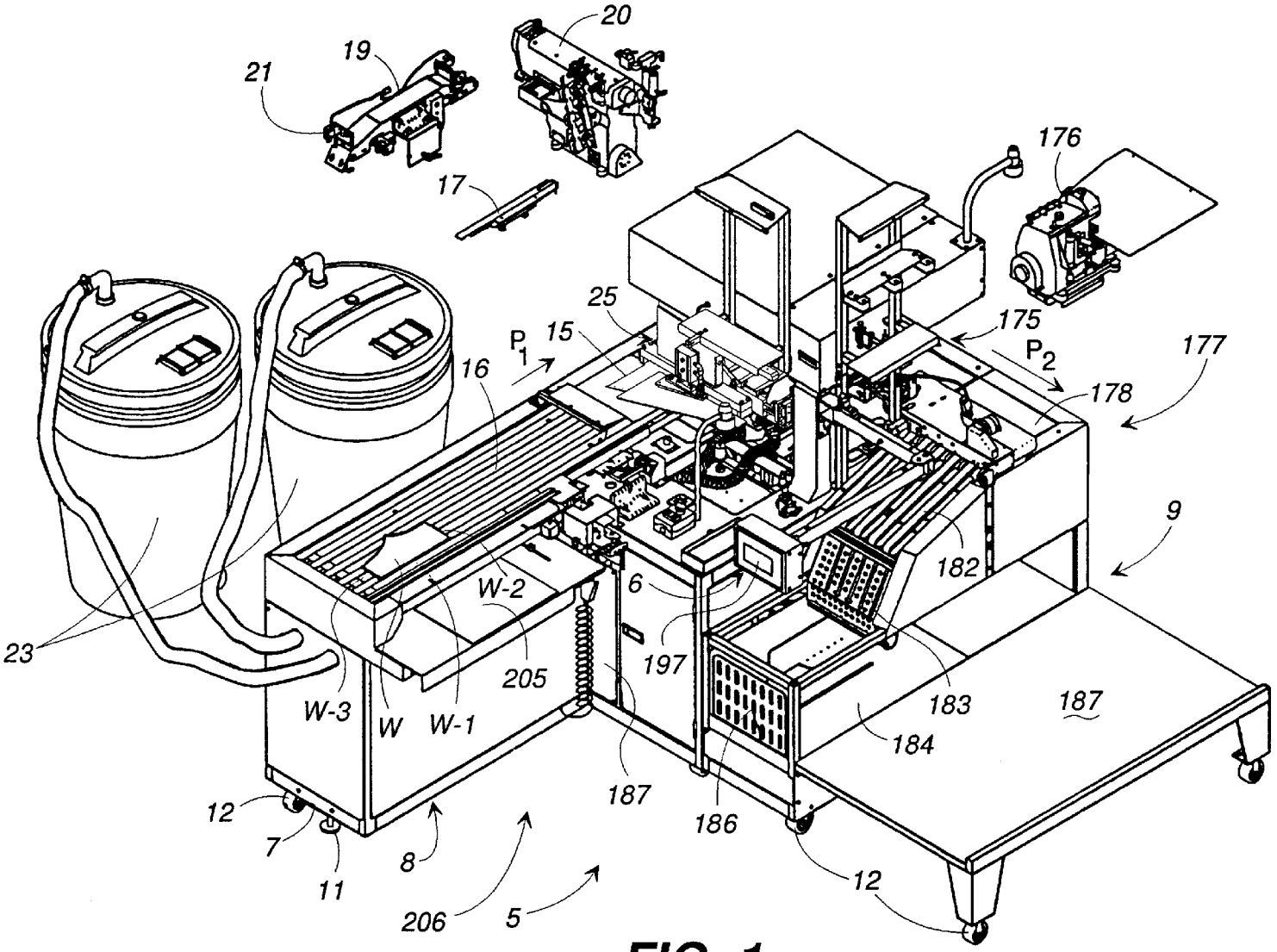
FIG. 1 is a perspective view of a preferred embodiment of the hemming and seaming machine of this invention.
Figure 2:
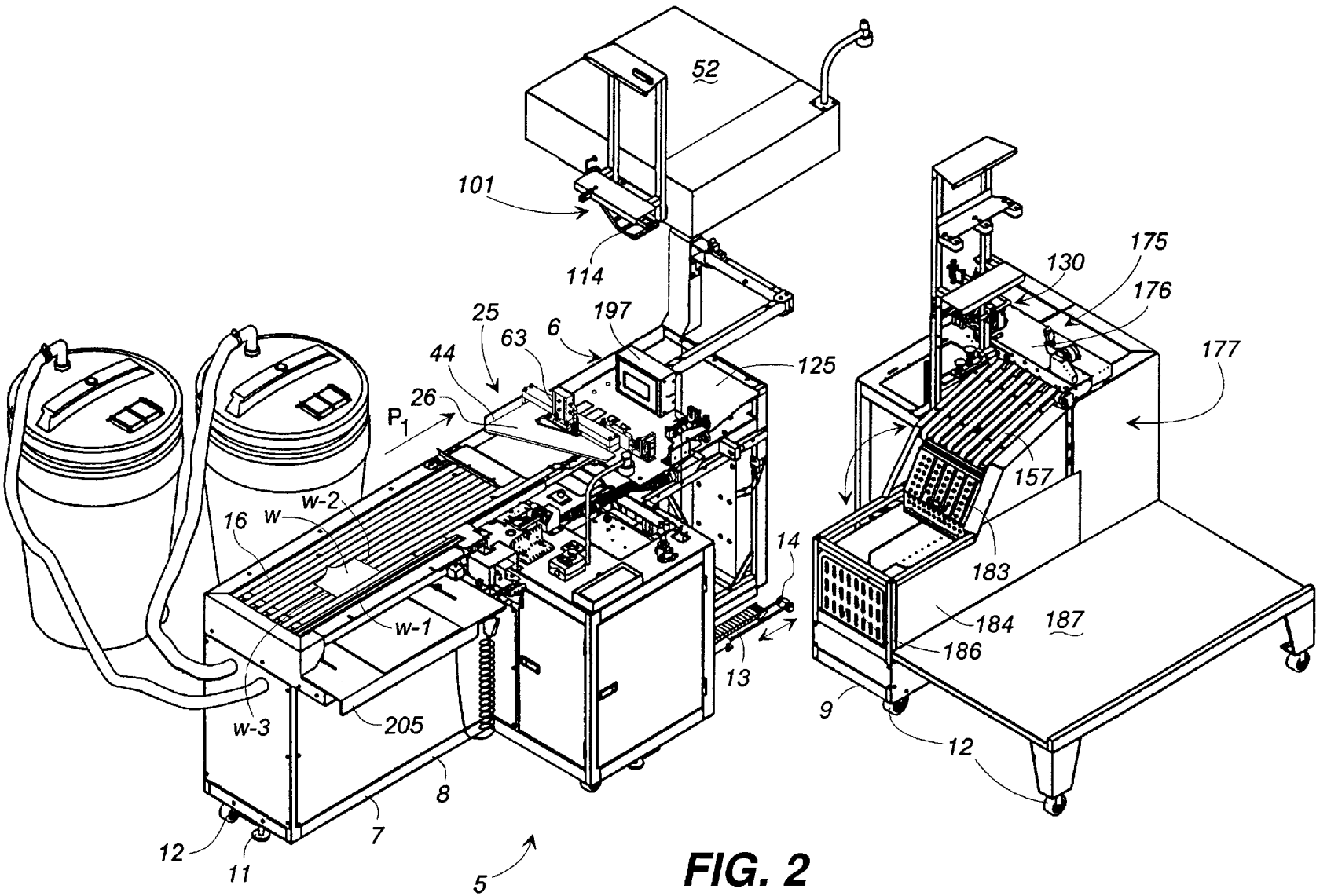
FIG. 2 is a perspective view of the machine of FIG. 1, showing the hemming and seaming machine separated into two subframe components.

Referring now to the drawings, in which like reference numerals indicate like parts throughout the several views, FIGS. 1 and 2 illustrate a preferred embodiment of a hemming and seaming machine 5, hereinafter referred to as the "machine". The machine 5 has a computer control system, generally indicated at 6, and a generally U-shaped cabinet-styled framework 7 comprised of a first subframe assembly 8 and a second subframe assembly 9, as best shown in FIG. 2. The two subframe assemblies of the machine can be moved apart from one another for ease of maintenance, inspection, repair, and/or updating of the machine during its use. As shown in FIG. 2, subframe assembly 9 has a plurality of rollers 12 constructed and arranged to allow for positioning of the machine as well as for moving subframe 9 away from subframe 8. A transport cylinder 13 is mounted to subframe 8 and includes an extensible cylinder rod 14 which is operably engaged with subframe 9 for moving subframe 9 toward and away from subframe 8. When the two subframes are drawn together, as shown in FIG. 1, they are locked into position such that the two subframes form a rigid and durable U-shaped frame. Transport cylinder 13 (FIG. 2) will preferably be a pneumatic cylinder, or may include other suitable types of cylinders including, for example, a hydraulic cylinder.

As best shown in FIGS. 1 and 2, machine 5 includes a series of work stations, such as a hemming station 15 positioned at an upstream end of a first path of travel, denoted by the reference character "$P_1$". The hemming station 15 includes a spaced series of endless parallel conveyor belts forming a hemming conveyor 16 that extends along and moves in the direction of the path of travel from an upstream end toward a downstream end of subframe 8. As shown in FIGS. 1 and 2, however, hemming conveyor 16 does not extend all the way to the downstream end of the subframe, rather it terminates at a smooth surfaced transport table 125, the use of which is described in greater detail below.

A hemming folder 17 (FIG. 1) is positioned at hemming station 15, extending along and parallel to the hemming conveyor 16. The hemming folder is constructed and arranged to fold a first elongate straight side edge of workpiece W, shown in FIGS. 1 and 2, under itself to form a hem in the workpiece. A series of air jets 18 (FIG. 3) are typically mounted along the back side of the top conveyor, and direct streams of air laterally across the width of the workpiece for eliminating folds or curls in the workpiece as it is hemmed. A top conveyor 19 (FIG. 1) is provided in conjunction with the hemming folder 17 for moving workpiece W along the first path of travel toward and into engagement with a hemmer sewing head 20 positioned at the downstream end of the hemming folder 17 and conveyor 16.

Hemming station 15 includes a first detector or sensor 21 (FIG. 1) which is mounted at the upstream end of the top conveyor. It is anticipated that the detector will be a photoelectric sensor or similar detection device that detects the presence and absence of the leading and/or trailing edges of each workpiece passed thereby. If the workpiece is not detected for a predetermined period of time, the computer control system 6 shuts the machine 5 down until it is restarted.

Hemmer sewing head 20 can comprise any of the known types of sewing heads manufactured by Yamato, Pegasus, Rimoldi, or other suitable sewing heads known to those of skill in the art. The hemming sewing head 20 receives the folded edge of the workpiece and sews a line of stitches therealong to complete formation of the hem in the workpiece. A second, sewing control sensor 22 (FIG. 3) is mounted upstream of the sewing head 20, and generally is a photoelectric sensor or other detector, for example a proximity detector, directed toward the area of the sewing head. The sewing control sensor detects the leading and trailing edges of the workpiece to control the operation of the sewing head 20. Hemming station 15 (FIG. 1) also is provided with at least one, and in this instance two, waste container assemblies 23 adapted to receive trimmed cloth scraps, or thread chains left over from the sewing of the hem in, and/or from the seaming of the workpiece.

Figure 3:
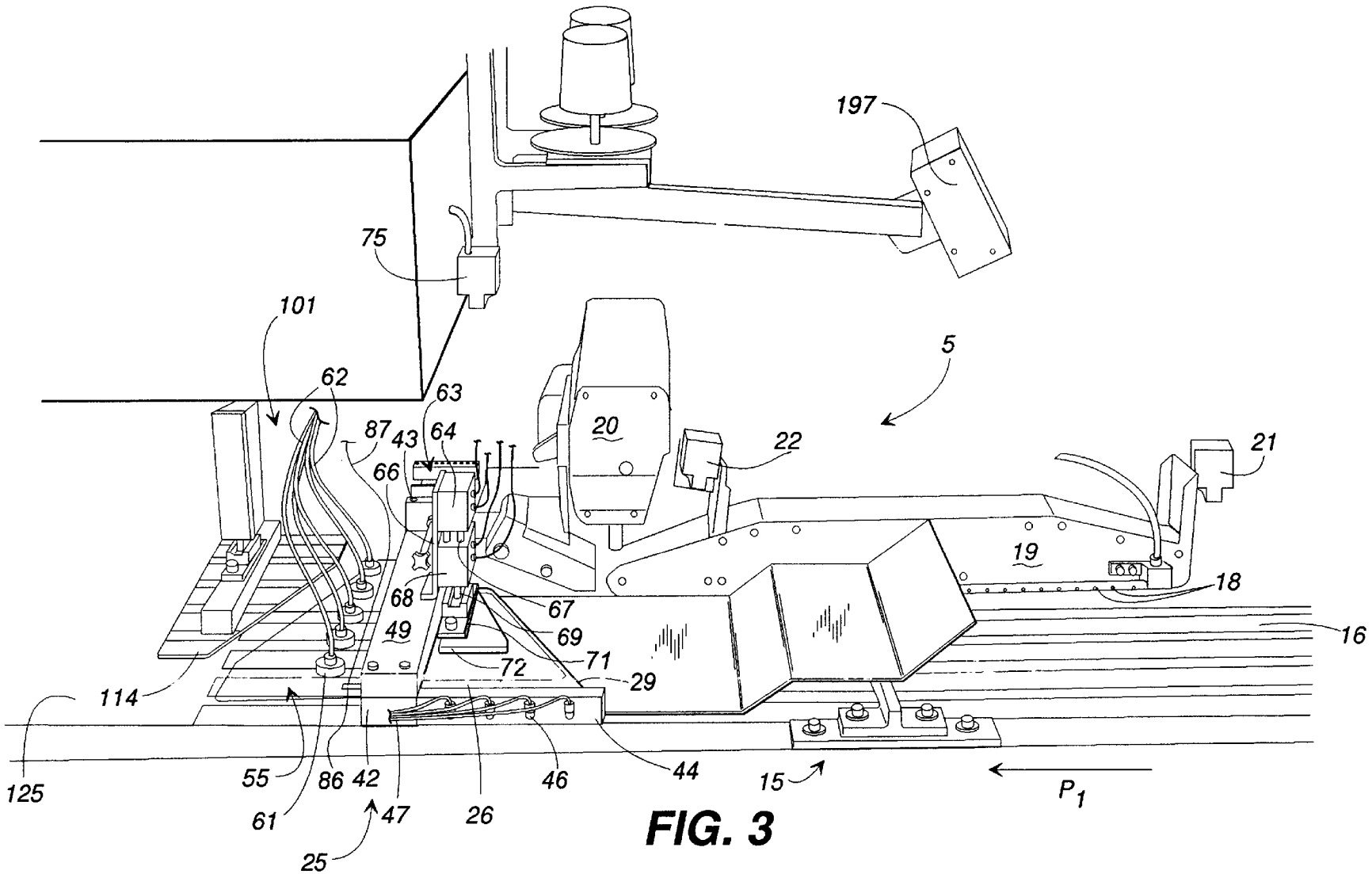
FIG. 3 is a side elevational view of the folding and hemming stations.
Figure 4A:
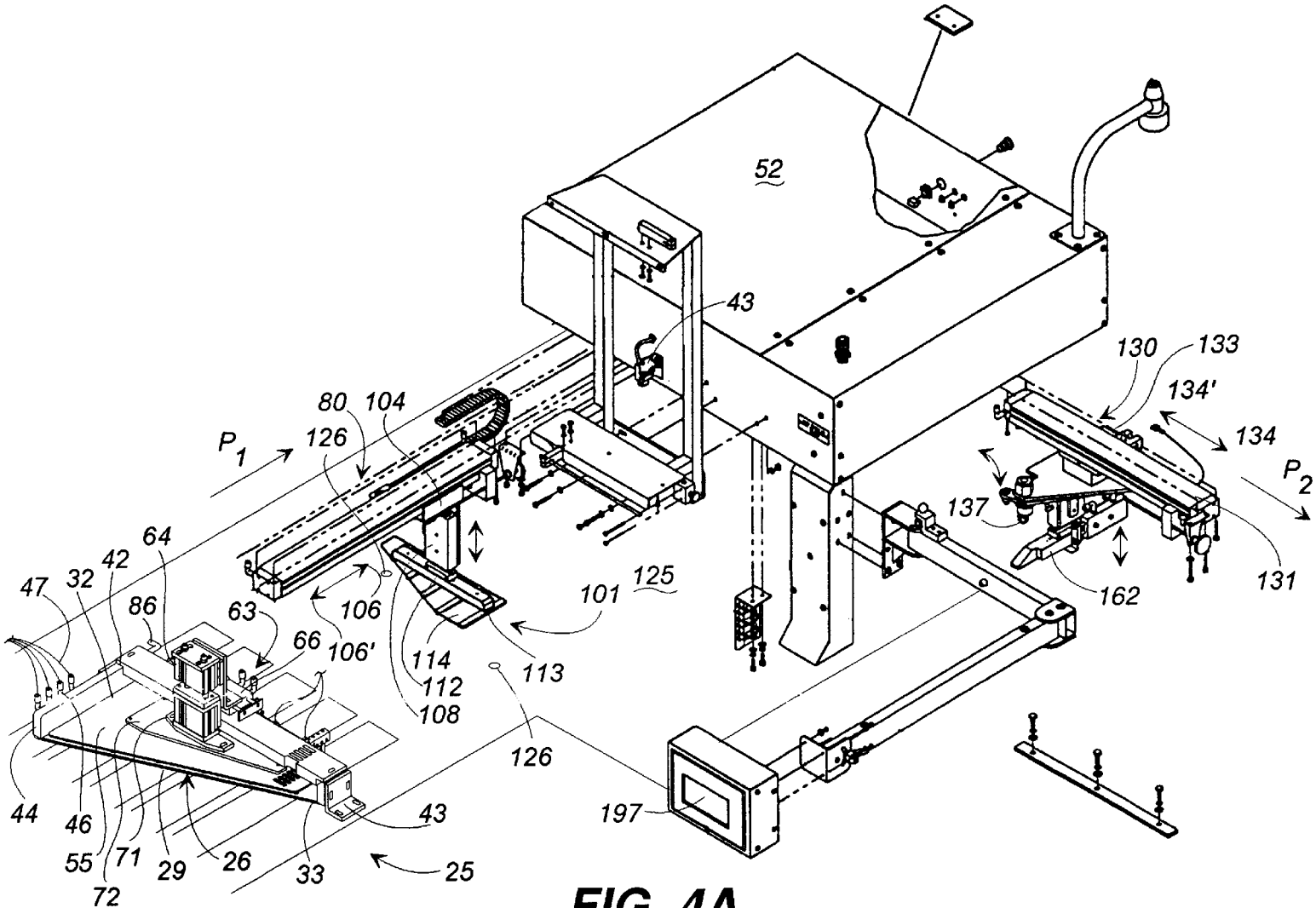
FIG. 4A is a partial exploded perspective view of the folding station, the first transport clamp assembly, and the second transport clamp assembly of the hemming and seaming machine of FIG. 1.
Figure 4B:
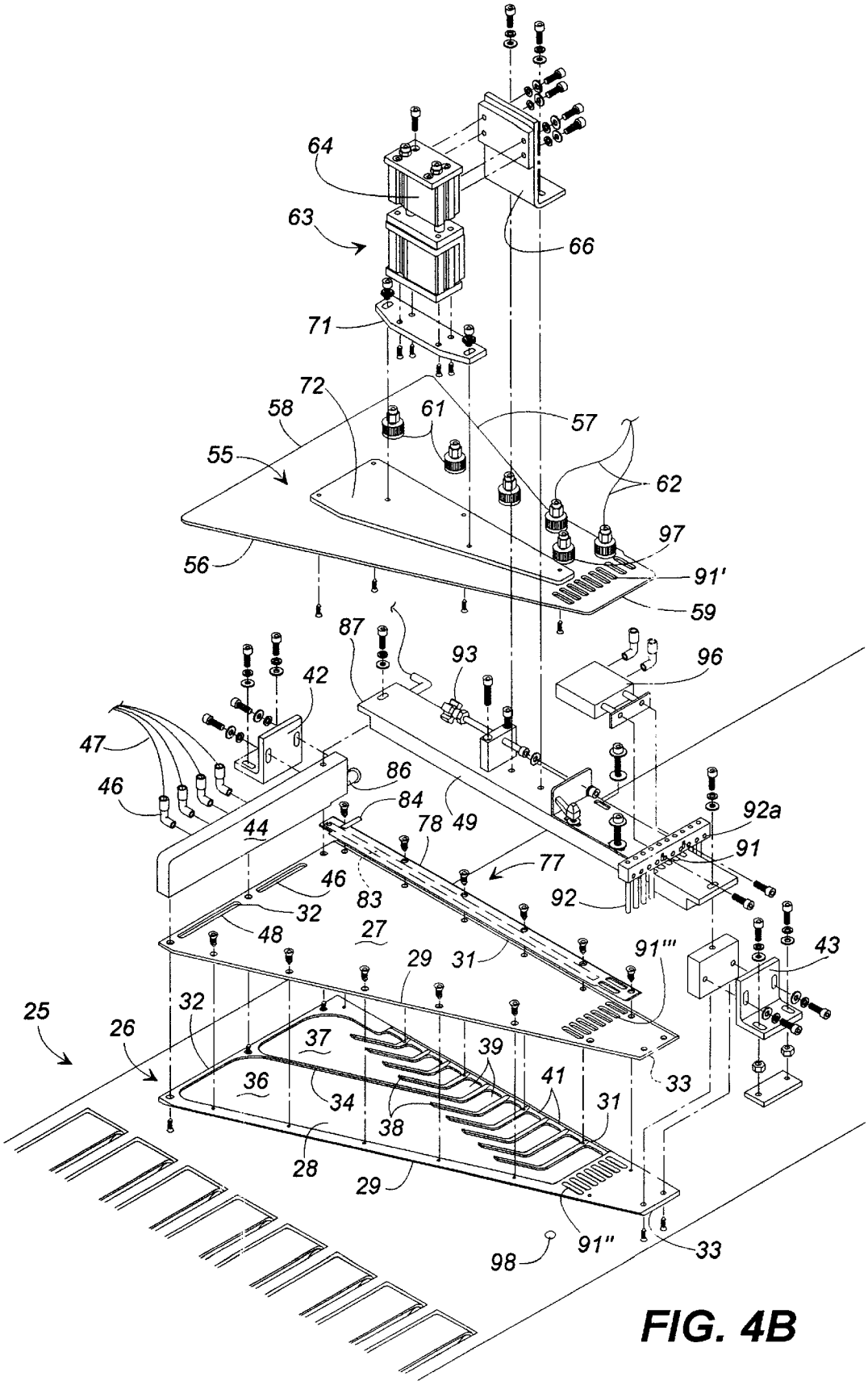
FIG. 4B is an exploded perspective view of the folding station of the hemming and seaming machine of FIG. 1.

Downstream of hemming station 15, positioned along hemming conveyor 16, is a second workstation, folding station 25, which is illustrated in greater detail in FIGS. 3–4B. The folding station generally includes a substantially triangularly shaped folding plate 26 mounted above the downstream end of the hemming conveyor 16 along the first path of travel $P_1$ of the workpiece. As FIG. 4B indicates, the folding plate is generally formed from metal such as polished steel or similar materials, including plastics, having a smooth surface, and includes an upper plate 27 and a lower plate 28 attached together in a sandwich type construction and includes an angled upstream edge 29, a substantially straight, laterally extending downstream edge 31, and first and second side edges 32 and 33. The lower plate 28 further includes an elongate central partition or wall 34 that extends partially parallel to the upstream edge 29 of the folding plate and divides the lower plate into two chambers 36 and 37. A series of shorter spaced elongate partitions or ribs 38 are formed in the lower plate extending rearwardly from downstream edge 31 of the folding plate so as to define a series of channels 39 therebetween, which terminate at a plurality of ports 41 defined along the downstream edge 31 of the folding plate.

As illustrated in FIGS. 3, 4A and 4B, the folding plate 26 is mounted in a position spaced above the hemming conveyor 16, supported by brackets 42 and 43 mounted to the framework of the machine. Support bracket 42 is mounted along the first side edge 32 of the folding plate, as shown in FIG. 4B, and is attached to an air plenum 44 that is mounted on the upper plate 27 of the folding plate, and extends along the first side edge of the folding plate. The air plenum generally is a substantially rectangularly shaped block having an internal air channel (not shown) defined therein with ports (not shown) defined along its bottom side surface, and further includes a series of air fittings or connectors 46 that connect to the air plenum along its outer side edge as illustrated in FIG. 4B. The air fittings are connected via hoses or conduits 47 to a pressurized air supply (not shown) for supplying a high velocity low volume air flow to the air plenum. The air plenum communicates with the internal chambers 36 and 37 of the folding plate via ports or slots 48 defined in the upper plate 27 of the folding plate 26 so as to supply a high velocity low volume air flow to the chambers of the folding plate in which the air flow is diffused through the chambers 38 and channels 39 and exits the folding plate through ports 41 along the downstream side edge 31 of the folding plate as a low velocity high volume air flow or series of flows. As additionally shown in FIGS. 4A and 4B, a rectangular support bar 49 is mounted to the support brackets 42 and 43, spaced above the downstream side edge of the folding plate and extending laterally across the hemming conveyor.

A clamping plate 55 is shown in FIGS. 3–4B positioned above and substantially parallel to the folding plate 26. The clamping plate typically is constructed of a translucent or clear plastic, preferably a polycarbonate, polyvinylchloride or a similar material, having a smooth exterior surface. It is also possible to form the clamping plate of metals such as aluminum or steel, if so desired. The clamping plate is positioned between the support bar 49 and upper plate 27 (FIG. 4B) of the folding plate and includes an upstream side edge 56 that extends substantially parallel to the upstream side edge 29 of the folding plate, a downstream side edge 57 spaced from and being substantially parallel to downstream side edge of the folding plate, and side edges 58 and 59. A series of leading edge air jets 61 are mounted adjacent the downstream side edge 57 of the clamp plate for selectively directing a stream of air along the lower surface of the clamping plate between the clamping plate and folding plate. Typically, four to five air jets are used, mounted in spaced series across the clamping plate, and generally may include air jets manufactured by, for example, Soffie, or similar conventionally known types of air jets. Conduits or hoses 62 (FIG. 3) connect the air jets to a pressurized air supply such as an air compressor (not illustrated).

The air jets of the clamping plate blow a stream of air in a direction opposite the direction of the path of travel $P_1$ of the workpiece, and between the folding and clamping plates so as to create a venturi effect or vacuum between the folding and clamping plates. This vacuum causes the leading edge of a workpiece to be drawn upwardly off of the hemming conveyor 16 and into the space between the folding and clamping plates. The air flow through the air jets 61 generally will be controlled by any desired pilot valves (not illustrated), and/or solenoid valves (not illustrated) as will be the air supply for the air plenum 44 of the folding plate, controlled by the computer control system of the machine. The air flow supplied to the air jets 61 typically will be under pressures of between 15–40 psi, although greater or lesser pressures also can be used, with the pressure of the air being supplied through the air jets being dependent upon the type of fabric being hemmed, folded, and seamed by the machine, i.e. with greater air pressures being used for stiffer or heavier fabrics.

The clamping plate 55 is mounted to and supported by a dual cylinder assembly 63 for moving the clamping plate vertically toward and away from the folding plate. The dual cylinder assembly includes an upper two-way cylinder 64 that is mounted to a support bracket 66 attached to and extending upwardly from the rectangular support bar 49 as illustrated in FIG. 4B. The upper cylinder includes a pair of cylinder rods 67 (FIG. 3) that extend downwardly and are attached to a lower two-way cylinder 68. The lower cylinder 68 thus is supported and moved by the operation of the upper cylinder extending and retracting its cylinder rods 67. The lower cylinder likewise includes cylinder rods 69 that are attached to an adjustment subplate 71 that is mounted to mounting plate 72, connected to the upper surface of the clamping plate 55.

The upper and lower cylinders act together and/or independently to raise and lower the clamping plate as the cylinder rods are extended and retracted, so as to move the clamping plate between a raised, open position, a partially closed position creating an aligning gap between the folding and clamping plates, and a fully closed, lowered clamping position in engagement with the clamping plate so as to clamp and hold the workpiece therebetween. For example, as the workpiece initially is drawn between the folding and clamping plates, the upper cylinder is actuated, causing its cylinder rods to extend and lower the lower cylinder and clamping plate to the partially closed position so as to create an aligning gap between the folding and clamping plates for aligning the hemmed edges of the workpiece. After a sufficient leading edge portion of the workpiece has been drawn between the folding and clamping plates, the second cylinder then is actuated so as to fully lower the clamping plate into its lowered, clamped position with the workpiece clamped and held between the folding and clamping plates.

As shown in FIG. 3, a third detector 75, a folding sensor, is mounted to the machine frame above the folding and clamping plates immediately downstream of the sewing head 20 of hemming station 15. The folding sensor 75 generally is a photoelectric sensor, but also could include a proximity sensor or similar detector, adapted to read or detect the presence of leading and trailing edges of the workpiece as they enter the folding station. In response to detection of the leading edge of the workpiece, the sensor will signal the computer control system of the machine to actuate the air jets 61 to start the folding operation. In response to the detection of the trailing edge of the workpiece, the folding sensor signals the computer control system to disengage the clamping plate 55 from the folding plate 26 to deactivate the air jets to complete the folding operation.

Figure 5A:
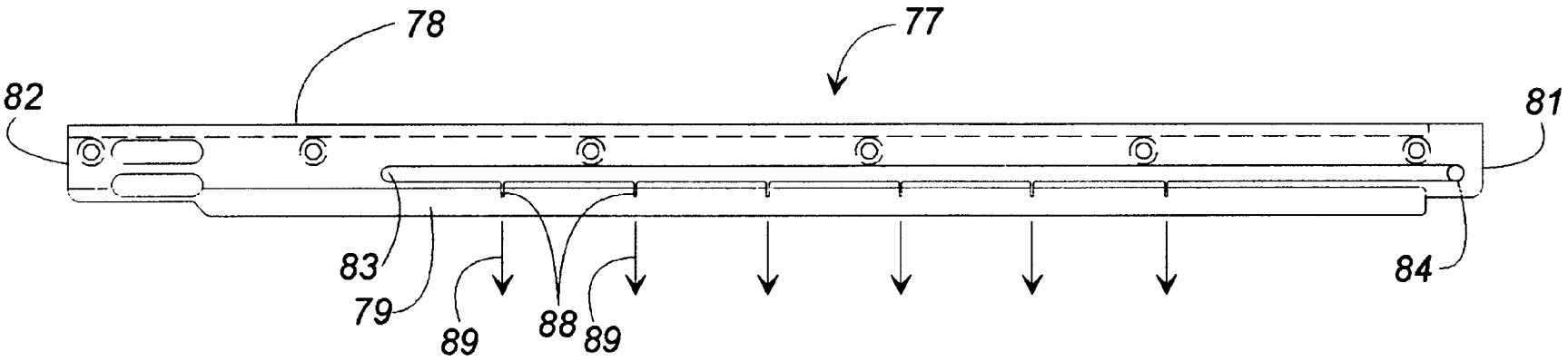
FIG. 5A is a bottom plan view of the separator blade of the folding station shown in FIG. 4B.
Figure 5B:
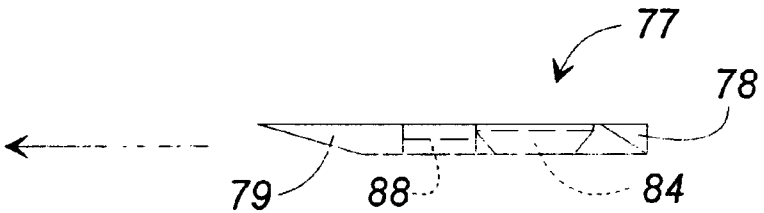
FIG. 5B is an end view of the separator blade of FIG. 5A.

As shown in FIG. 4B, a separator blade 77 is mounted to the upper plate 27 of the folding plate 26, extending along the downstream side edge 31 thereof. The separator blade 77 generally is an elongated, thin flat blade, illustrated in FIG. 5B, having a downstream side edge 78, a beveled or angled upstream side edge 79 and side edges 81 and 82 (FIG. 5A). The separator blade further includes an internal air distribution channel 83 defined therein, having an air port or connection opening 84 formed adjacent one of the side edges of the separator blade, here side edge 81. The air port or connection opening 84 communicates with a port (not shown) formed in the air plenum 44 and with an air fitting 86 (FIGS. 3, 4B) that connects to the downstream side of the air plenum 44. The air fitting 86 is connected to the air supply (not illustrated) which supplies the compressed air to the air jets 61 and fittings for the folding station, and is connected thereto by a hose or conduit 87. Compressed or pressurized air thus is supplied to the separator blade and is passed through the internal air channel 83 and discharged from the separator blade along its length through a series of ports 88 (FIG. 5A) as indicated by arrows 89.

As the leading edge of the workpiece is drawn upwardly and over the separator blade and between the folding and clamping plates, the air flow is discharged from the upstream side edge 79 of the separator blade and blows against the bottom of the workpiece so as to prevent any curling or under-folds being formed in the leading edge of the workpiece as the clamping plate engages the leading edge portion of the workpiece against the folding plate. Likewise, as the leading edge portion of the workpiece is being moved from between the folding and clamping plates at the end of a folding operation, the beveling of the upstream side edge 79 creates a point or sharpened edge that tends to catch any curls or under-folds formed in the leading edge of the workpiece as it moves thereover, causing such under-folds to be removed and the leading edge of the workpiece to be flattened out. The separator blade thus acts to prevent or minimize the formation of any under-folds or curls in the leading edge portion prior to folding, and further ensures that even if such under-folds are formed, they will be removed prior to the completion of the folding operation.

As shown in FIG. 4B, a series of slots 91, 91', 91" and 91'" are defined in and extend through the rectangular support bar 49, clamping plate 55, separator blade 77, and the upper and lower plates 27, 28 of the folding plate 26, respectively. Each of the slots is an elongate, elliptical shaped opening with the slots of the rectangular support bar, clamping plate, separator blade and folding plate, all being vertically aligned with one another for receiving one of a series of spaced guide or alignment pins 92 therein. The guide pins extend downwardly from a carrier block 92*a* and through the support bar, and the clamping and folding plates to form an alignment guide or stop against which the hemmed edge of the workpiece can be urged to ensure that the hemmed edge of the upper or leading edge portion, and the lower or trailing edge portion of the workpiece are placed in vertical alignment on one another during the folding operation. A travel screw 93 or adjustment knob is mounted on support bar 49 and operably fastened to carrier block 92*a* for adjusting the lateral position of the guide pins within the respective slots for adjusting the alignment position of the hemmed edges of the workpiece.

An adjustment cylinder 96 also can be provided, as desired, as indicated in FIG. 4B, which will be mounted to the rectangular support bar 49 and fastened to the carrier block 92*a*. The adjustment cylinder 96 can be used for moving the alignment pins outwardly and away from engagement with the hemmed edges of the workpiece during the initial stages of the folding operation as the leading edge portion of the workpiece is first drawn between the clamping and folding plates, and to thereafter move the guide pins into engagement with the hemmed edges of the workpiece as the leading edge portion of the workpiece is pulled from between the folding and clamping plates during the completion of the folding operation of stiffer or heavier fabrics that might otherwise tend to bunch or become improperly folded by engagement with the alignment pins as the leading portions of the workpiece initially are drawn between the folding and clamping plates.

In addition, an aligning air jet 97 is mounted to the clamping plate adjacent the slots 91' formed therein.

Similarly, an aligning air jet 98 (FIG. 4B) is mounted below the folding plate in the surface of transport table 125, positioned adjacent the slots 91'". Each of the aligning air jets directs a flow of air at an angle toward the guide pins 92 such that the upper aligning jet 97 tends to urge the leading edge portion of the workpiece toward the guide pins 92 while the lower air jet 98 tends to urge the trailing edge portion of the workpiece toward the guide pins so that the hemmed edges of the workpiece are urged and held against the guide pins to align the hemmed edges of the workpiece during the folding process.

Figure 6B:
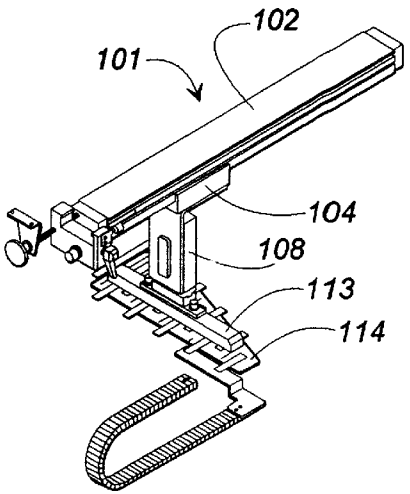
FIG. 6B is a perspective view of the first transport clamp assembly of FIG. 6A in its assembled configuration.
Figure 6A:
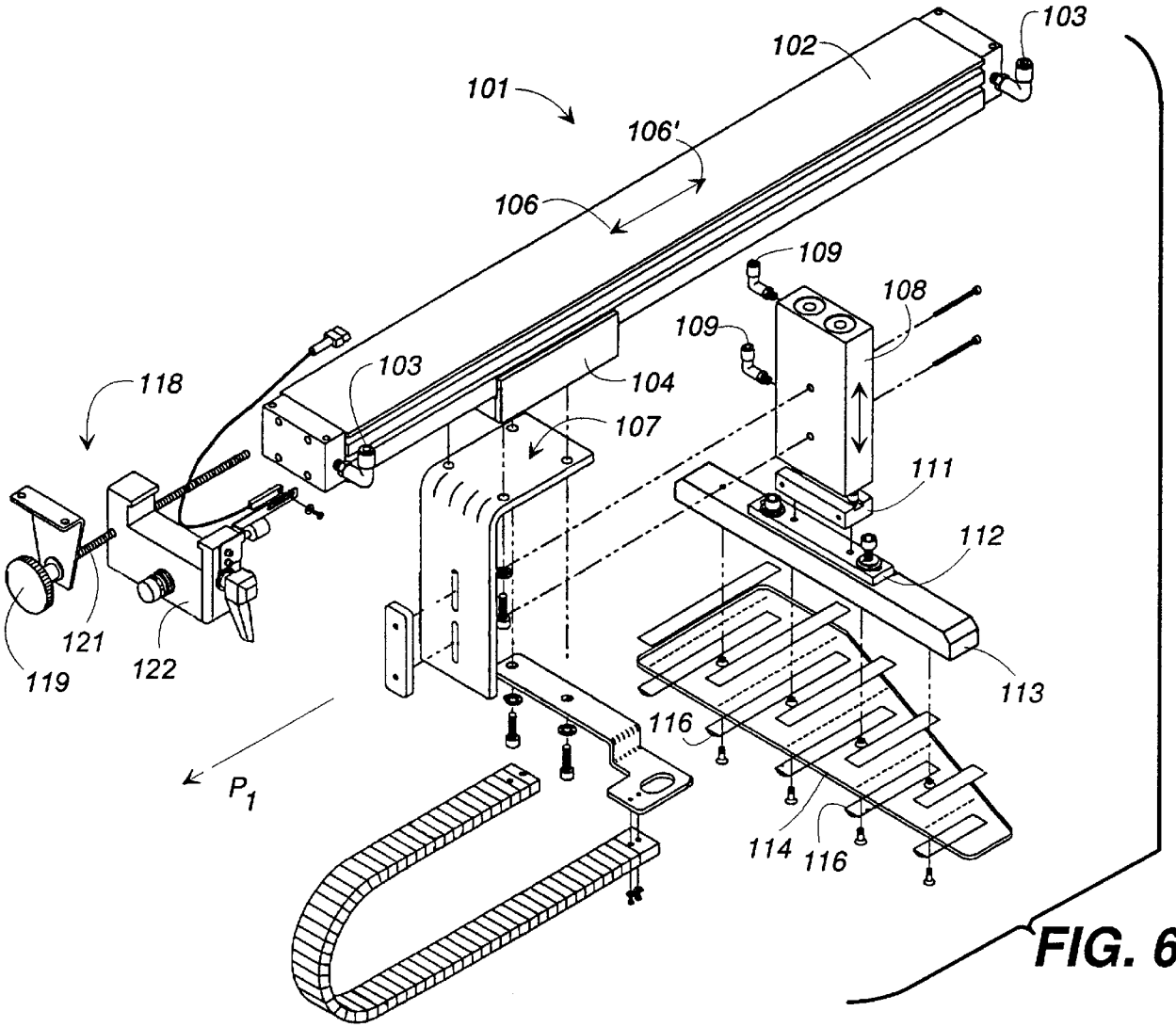
FIG. 6A is an exploded perspective view of the first transport clamp of the hemming and seaming machine of FIG. 1.

As shown in FIG. 3, a first transport clamp assembly 101 is positioned downstream of and spaced with respect to folding station 25. First transport clamp assembly 101 is illustrated in greater detail in FIGS. 6A and 6B, and includes an elongate two-way rodless cylinder 102 having a pair of pneumatic inlets/outlets 103 for supplying air to the cylinder to cause a carrier 104 to be reciprocably moved along the length of the cylinder in the direction of arrows 106 and 106'. A substantially L-shaped mounting bracket 107 is attached to the carrier 104 and is further attached to a two-way, dual rod cylinder 108 so that the cylinder 108 is moved along the first path of travel $P_1$ of the workpiece in the direction of arrows 106 and 106' with the movement of the carrier. Cylinder 108 includes a pair of pneumatic inlets/outlets 109 for supplying a flow of air thereto, and a reciprocable foot 111 that is attached at the end of a pair of cylinder rods (not shown), and which is fastened to a mounting plate 112. The mounting plate 112 in turn is fastened to a clamp bar 113 which supports a transport clamp or plate 114 attached thereto by screws, rivets or other similar fasteners.

It is anticipated that clamp plate 114 will be constructed of the same material as is the clamping plate of the folding station, i.e. a polycarbonate plastic or similar material. The clamp plate 114 further includes a series of spaced elongate rubber grommet strips 116 applied to its lower underside surface generally by glue or a similar suitable adhesive. The rubber grommet strips engage the upper portion of the workpiece when cylinder 108 is actuated to hold the workpiece beneath the clamp plate 114 as the clamp plate is moved in the direction of arrow 106 to move the workpiece away from the folding station 25.

The first transport clamp assembly 101 engages the upper portion of the folded workpiece when cylinder 108 is actuated so as to move the clamp plate 114 downwardly into a first, engaging position (not illustrated). Travel cylinder 102 then is actuated by the computer control system of the machine, causing the carrier 104 to be moved in the direction of arrow 106 so as to accelerate the workpiece away from the folding station along the first path of travel $P_1$ at a first rate of speed greater than the rate of speed at which each workpiece is moved by the hemming conveyor, toward a second release position. In order to prevent the formation of a curl in the folded leading edge of the workpiece due to momentum from a sudden stop at its first rate of speed as it approaches the second release position, cylinder 102 is decelerated to a second rate of speed less than the first rate of speed so that the workpiece does not collapse or curl as the leading edge of the workpiece comes to a stop at its release position. An adjustable stop assembly 118 is mounted at the downstream end of the cylinder 102 for adjusting the stop position of the carrier 104 along the length of the cylinder. The stop assembly includes a hand adjustment knob 119 attached to a travel screw or adjustment member on which is mounted a stop block or member 121. Thus, the release position of the clamp plate 114 of the first transport clamp assembly can be adjusted as desired depending on the size of the workpiece by adjusting of the position of the stop block along the length of cylinder 102.

As shown in FIGS. 2 and 4A, the smooth surfaced transport table 125 is generally formed of stainless steel or similar metals and has a polished upper transport surface positioned downstream of that portion of the hemming conveyor 16 extending beneath the first transport clamp assembly 101. It is over this surface that clamp plate 114 (FIG. 4A) slides the hemmed and folded workpiece after the workpiece has been folded at the folder station. In order to assist the sliding of the workpiece across the transport table, the transport table may include a series of spaced directional pressurized air jets 126 mounted flush within the upper surface of the transport table. These air jets typically may include air flotation system jets such as the "Zippy Adjustable Directional Feeding Air Flotation Systems" jets marketed by Profeel, Inc. of Atlanta, Ga., or similar air flotation systems or devices. The air jets will create an air flotation cushion beneath the lower portion of the folded workpiece so as to assist in moving it across the surface of the transport table without inducing wrinkles, pulls, tears or curls in the workpiece as it is moved by the first transport clamp assembly to its release position (not illustrated), whereupon the first transport clamp assembly releases the workpiece as a second transport clamp assembly 130 is moved into engagement therewith.

Figure 7:
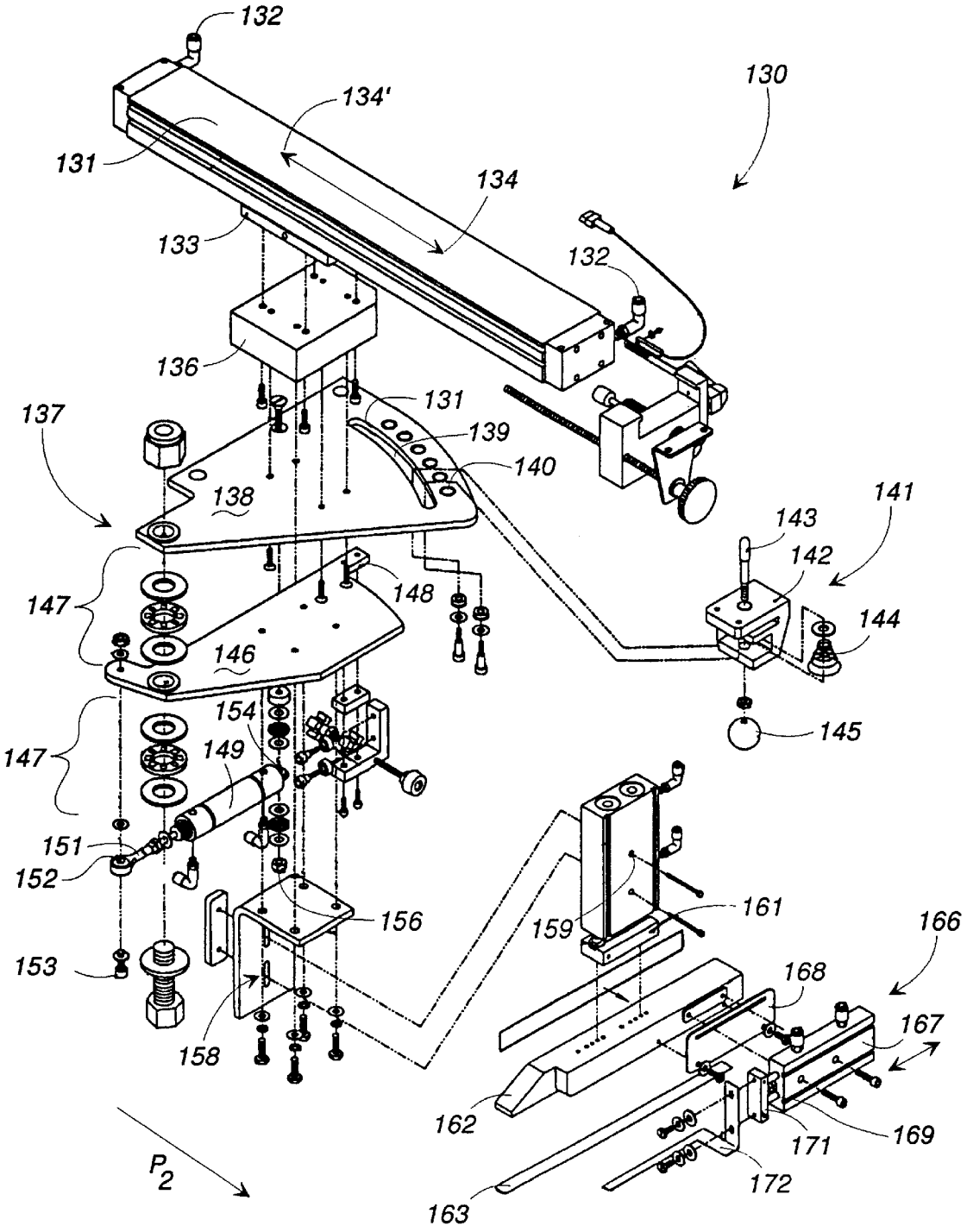
FIG. 7 is an exploded perspective view of the second transport clamp assembly of the hemming and seaming machine of FIG. 1.

The second transport clamp assembly 130 is illustrated in FIGS. 4A and 7 and, similar to the first transport clamp assembly, includes an elongate two-way rodless cylinder 131 that extends along a second path of travel denoted by reference character "$P_2$" along the second leg of the U-shaped frame of the machine. The rodless cylinder includes a pair of spaced pneumatic inlets/outlets for connecting the cylinder to an air supply and a carrier 133 that is mounted on and is movable along the length of the cylinder in the direction of arrows 134 and 134' along the path of travel $P_2$. A mounting block 136 (FIG. 7) is fastened to the carrier 133 with a plurality of fasteners, and supports and mounts a transport clamp rotate assembly 137 to the carrier so the transport clamp rotate assembly is moved with the movement of the carrier along the cylinder 131. The transport clamp rotate assembly enables the workpiece to be partially rotated as the workpiece is moved along the second path of travel $P_2$ for aligning the side edge of the hemmed and folded workpiece for seaming.

As illustrated in FIG. 7, the transport clamp rotate assembly 137 includes an adjustment plate 138 having an arcuate slot 139 defined therein, with a series of radially spaced indexing holes 140 defined along outside edge thereof. An adjustable stop assembly 141 is received and held within the arcuate slot 139 by fasteners such as Allen screws, and includes a clamp bracket 142 secured within the slot. The clamp bracket 142 carries an elongate stop pin 143 that projects upwardly through the clamp bracket, passing through a tensioning spring 144 held within the clamp bracket, and is attached to an adjustment knob 145 below the clamp bracket for drawing the stop pin downwardly against the tensioning spring to enable the clamp bracket to be moved in position along the slot with respect to the appropriate indexing hole 140 on adjustment plate 138. The clamp bracket 142 forms a portion of the stop assembly used to stop a pivot plate 146 from movement after the desired rotation of the workpiece.

The pivot plate 146 is positioned below and spaced from the adjustment plate 138, and is secured thereto by a series of spacers and bearings indicated collectively as 147. The pivot plate includes a stop 148 defined thereon which is adapted to engage the clamp bracket during rotation of the pivot plate. As shown in FIG. 7, a two-way pneumatic cylinder 149 is mounted below the pivot plate and includes a cylinder rod 151 with an eye 152 formed at one end thereof and fastened to the pivot plate 146 by a fastener 153, and includes a connector 154 formed at its opposite end which is fastened to the adjustment plate 138 by fastener 156. The cylinder 149 is actuated by the computer control system of the machine during the engagement of the workpiece by the second transport clamp assembly so that the pivot plate is moved with respect to the adjustment plate until the stop or protrusion 148 extending from the rear side edge of the pivot plate 146 engages the clamp bracket 142 to prevent further rotation of the pivot plate and thus of the workpiece being carried by the second transport clamp assembly.

As illustrated in FIG. 7, a mounting bracket 158 is attached to and extends downwardly from the pivot plate, and is also attached to and supports a two-way cylinder 159. Cylinder 159 includes a pair of extensible rods (not illustrated) attached to a reciprocable foot 161 that is fastened to an elongate clamp bar 162 having a rubber grommet strip 163 applied to its downwardly facing bottom side surface. The cylinder 159 raises and lowers its reciprocable foot, and thus raises and lowers the elongate clamp bar upon actuation by the computer control system of the machine to engage the upper portion of the folded and hemmed workpiece for moving the workpiece away from the first transport clamp assembly along the second path of travel $P_2$ with the movement of the carrier 133 along cylinder 131. A hem clamp assembly 166 is fastened to the clamp bar 162 and includes a two-way dual rod cylinder 167 fastened to the clamp bar by a mounting plate 168. The cylinder 167 further includes cylinder rods 169 to which is attached a foot 171 that is movable laterally across the path of travel $P_2$ with the extension and retraction of the cylinder rods. The foot is attached to a hem clamp 172 which extends away from the cylinder and is moved in position across the upper surface of the workpiece engaged and held by the second transport clamp assembly to clamp the top and bottom portions of the hemmed edge of the workpiece in alignment with one another as a seam is sewn in the workpiece.

Prior to the release of the workpiece by the first transport clamp assembly 101 (FIG. 4A), the second transport clamp assembly 137 engages the workpiece. After the release of the workpiece by the first transport clamp assembly, the second transport clamp assembly moves the workpiece along the second path of travel $P_2$ in a direction normal to the first path of travel toward a downstream seamer station 175, as illustrated in FIGS. I and 2, with the actuation of cylinder 131 (FIG. 4A). Although not specifically illustrated in FIGS. 1 and 2, it further should be understood that a second series of spaced directional air jets also could be provided for assisting in the movement of the workpiece by the second transport clamp assembly along the second path of travel $P_2$ toward the seamer station.

The seamer station 175 is illustrated in FIGS. 1 and 2. The seamer station includes a seamer sewing head 176 of a type known to those of skill in the art, and may include those seamer sewing heads manufactured by Yamato, Pegasus, or Juki. It is also understood by those skilled in the art, although not illustrated specifically herein, that seamer station 175 will be provided with a rotatable guide assembly, and conveyors, used to move the hemmed and folded workpiece through the seamer and into engagement with the needles of the sewing head to form any desired seam in the workpiece during the seaming operation. Seamer station 175 also typically includes a conveyor (not illustrated), for example a top conveyor, used to assist in moving the workpiece from the seamer sewing head toward a downstream workpiece stacking station 177, illustrated in FIGS. 1 and 2, which lies along the third leg of the U-shaped machine frame.

The workpiece stacking station 177, shown in FIGS. 1 and 2, generally includes a hinged transfer or drop plate 178 positioned at the downstream end of the second path of travel $P_2$. As the workpiece is received on the transfer plate, a transfer plate or workpiece stacking station detector will signal the machine computer system, which will in turn drop transfer plate 178 (FIG. 1) such that the workpiece is transferred to a side conveyor 182, and moved toward a flip panel 183 pivotally fastened to the workpiece stacking station using a two-way air cylinder (not illustrated) to finished workpieces into a bundle tray 184 positioned with respect to the operator, such that the now finished workpiece has in essence been "returned" to the machine operator for visual inspection by the machine operator as the respective workpieces come off of the flip panel and are dropped into the bundle tray. The bundle tray is provided with a movable bundle tray indexing plate 186, generally driven by a pneumatic cylinder (not illustrated) for moving the stacked workpieces along the length of the bundle tray to form a bundle of workpieces, whereupon the bundles of workpieces are then moved by a pusher (not illustrated) onto an adjacent bundle tray 187 for collection and transport to other work stations for use in completing the manufacture of the clothing items with which the sleeves are associated.

Figure 8:
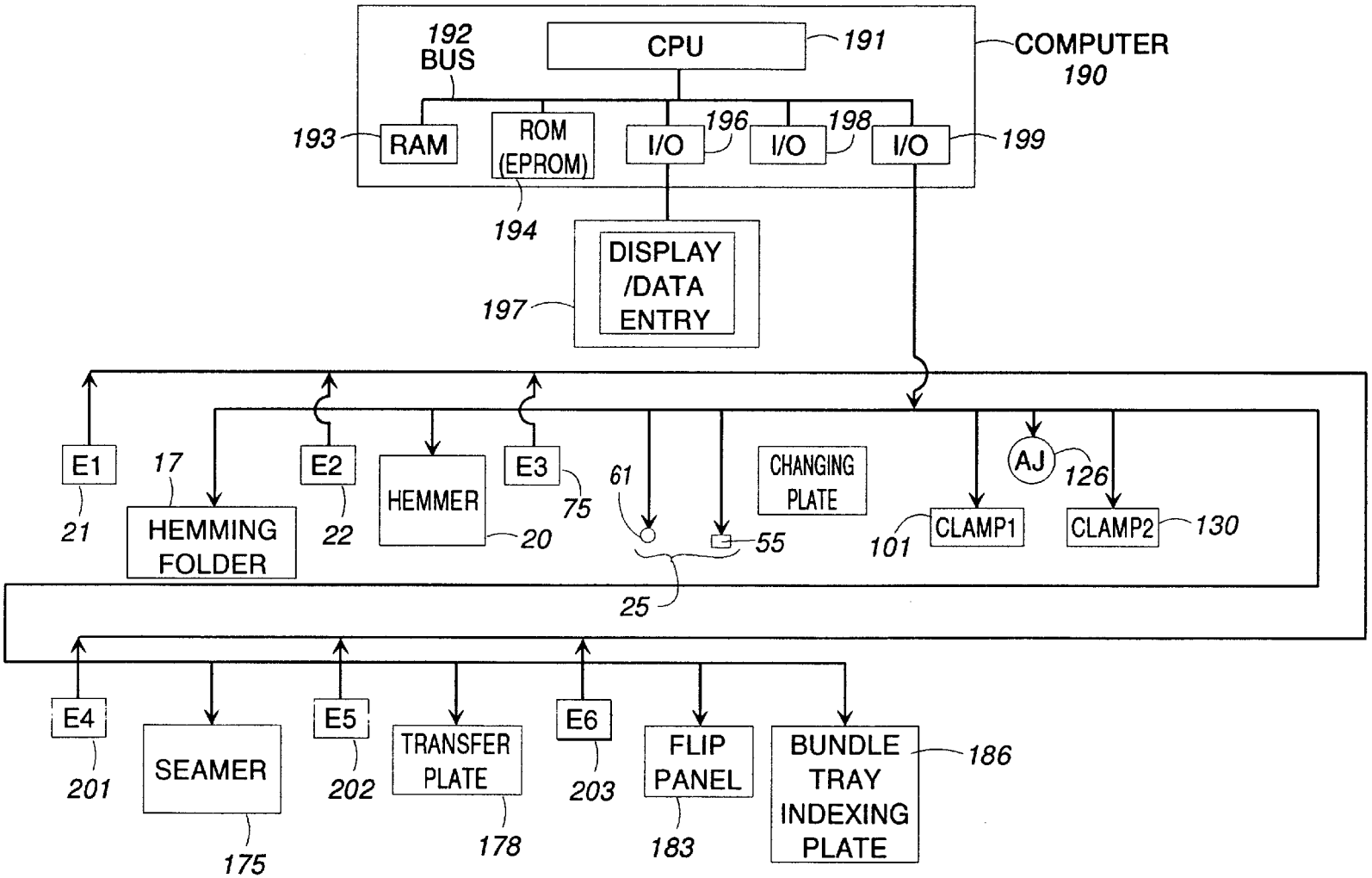
FIG. 8 is a schematic illustration of the control system used to operate the hemming and seaming machine of FIG. 1.

The machine 5, as illustrated in FIGS. 1–7, is automatically controlled by computer control system 6 which includes a computer 190, illustrated schematically in FIG. 8. The computer 190 will preferably be a Z8 microprocessor manufactured by Zilog, which computer is programmed in the Z8 assembly language, although it will be understood that similar microprocessors or computers capable of such control operations can be used in place of the Zilog Z8 microprocessor. Accordingly, CPU (central processing unit) 191 of computer 190 is a Zilog Z8 microprocessor. Computer 190 also includes a data bus 192 in communication with the CPU, a computer readable storage medium, such as RAM 193, which may comprise a magnetic hard disc drive, a magnetic floppy disc drive, a magnetic tape drive, a CD ROM drive, or other data storage means, and a ROM, or read-only memory 194, which in this instance comprises an EPROM onto which the operating program has been programmed as known to those skilled in the art. An outline of the machine operating sequence, as controlled by the program within EPROM 194, is appended hereto as the Appendix.

An input/output card 196 is provided, which is in communication with data bus 192, and with a data display/data entry device 197. It is anticipated that data display/data entry device 197, as illustrated in FIGS. 1 and 2, will typically will be a touch-sensitive data display and data entry screen, or an equivalent user interface. As the computer program is maintained in the EPROM 194 (FIG. 8) it is anticipated that the machine can be operated in relatively simple fashion merely by using a pre-programmed menu of options displayed on the touch-sensitive display screen 197. The computer 190 also has an input/output card 198 in communication with the data bus 192 and with the several detectors used in machine operation for inputting detected or measured conditions such as the presence or absence of a workpiece, or its leading and trailing edges, respectively, to the CPU. Lastly, computer 190 will have an additional input/output card 199 adapted to emit a control signal to the several components of the machine, as illustrated schematically in FIG. 8.

Still referring to FIG. 8, the machine 5 generally has seven detectors used to control the automatic operation of the machine. These seven detectors include a first detector, hemmer detector 21 positioned upstream of hemmer sewing head 20; a second detector, the sewing control detector 22 mounted adjacent the sewing head 20; a third detector, folding station detector 75 positioned upstream of folding plate 26 and clamping plate 55; a fourth detector, seamer detector 201 positioned upstream of the seamer 175; a fifth detector, workpiece stacking station (transfer plate) detector 202 positioned upstream of transfer plate 178; a sixth detector, a flip panel detector 203 positioned upstream of flip panel 183; and a seventh detector (not illustrated) comprising a full bundle table detector for bundle tray 187. Each of these detectors is preferably a photosensor or a proximity detector constructed and arranged to detect and signal when the leading, and trailing edges, respectively, of a workpiece pass therebeneath. Once detected, the detectors send the appropriate leading or trailing edge detection signal to computer 190 for action by CPU 191 in conjunction with the program stored in EPROM 194, whereupon the appropriate control signals are issued by the CPU 191 through data bus 192, and input/output card 199 to the appropriate elements of the machine as illustrated in FIGS. 1–9H.

Although not illustrated in specific detail herein, the motors used to drive the conveyors generally are variable speed motors, and the machine operates on a time delay basis in association with the receipt of the appropriate leading or trailing edge detection signals, as acted upon by the control program held in EPROM 194 and processed CPU 191 to emit the appropriate control signals to the machine components through input/output card 199.

Accordingly, the machine 5 can be operated in automated fashion for allowing for the accurate, concise, and repeatedly consistent manufacture of a quality finished hemmed, folded, and seamed sleeve at a quality level and at production rates heretofore unknown in the art.

OPERATION

The operation of the improved method and apparatus for providing a hemmed, folded, and seamed finished workpiece will now be described in greater detail with reference to FIGS. 1, 2, 4A, and the schematic illustration of FIGS. 9A–H.

Referring first to FIGS. 1 and 2, a workpiece blank, denoted by the reference character "W", is placed on the upstream end of hemming conveyor 16 positioned with respect to hemming folder 17 in a substantially flat, unfolded configuration.

Workpiece W generally is one of a bundle of workpieces (not illustrated), which will be held on a workpiece tray 205 (FIG. 1) positioned at the operator's station 206 of the machine 5. The straight side edge W-1 of the workpiece to be hemmed is placed against the side of hemming conveyor 16 closest to the operator's station, in line with the hemming station 15. As the operator engages the machine, for example by a foot or thumb switch actuated by the machine operator, the workpiece is moved in the direction of the path of travel $P_1$ through an edge trimmer (not illustrated) and the hemming folder, when, and as needed. As it moves through the folder, the side edge W-1 of the workpiece is folded under for forming the hem sewn into the workpiece by hemmer sewing head 20. As indicated in FIG. 8, the leading/trailing edges W-2 and W-3 of the workpiece will be detected by hemming folder detector 21 prior to entering hemming folder 17, whereupon a control signal is sent to the computer 190 controlling the operation of the hemming folder and the hemmer sewing head 20. If no workpiece is detected by detector 21, the automatic operation of the system is halted. The leading edge W-2 of the workpiece will then be detected by hemmer detector 22 prior to being passed to the hemmer sewing head, whereupon a control signal is once again sent to computer 190 to start the operation of the sewing head, which sews the hem in the workpiece. Thereafter, the now hemmed workpiece progresses along the path of travel on conveyor 16 toward folding station 25.

As indicated in FIGS. 3 and 8, the leading edge of the workpiece is detected by folding station detector 75 as the workpiece advances toward folding plate 26, passing underneath the folding plate as the workpiece moves along the path of travel. Once the leading edge of the workpiece has been detected by folding station detector 75, a signal is sent to computer 190 (FIG. 8) whereupon based upon the parameters of the control program held in EPROM 194, first air jets 61 (FIG. 3) are actuated. The air jets direct a flow of air in the direction opposite the path of travel of the workpiece, between the folding plate 26 and clamping plate 55 to create a venturi-effect air flow or vacuum therebetween. This venturi-effect air flow, or vacuum lifts the leading edge of the workpiece upwardly and starts moving the leading edge portion L (FIG. 9B) of the workpiece W between the folding and clamping plates.

Figure 9A:
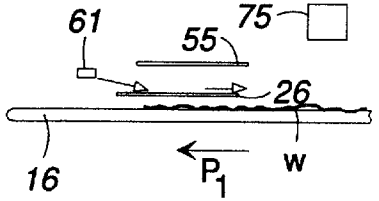
FIGS. 9A–9H are sequential, schematic, partial side elevational views of a hemmed workpiece being folded using the folding station of the hemming and seaming machine of FIG. 1.
Figure 9B:
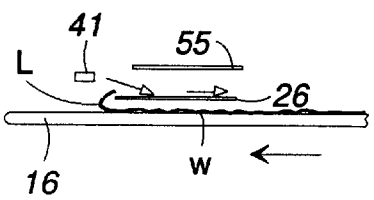
Figure 9C:
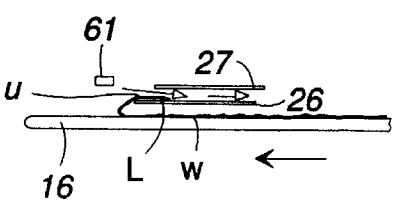
Figure 9D:
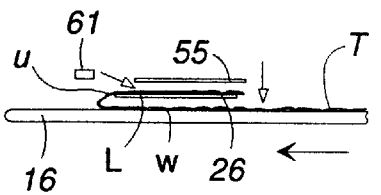
Figure 9E:
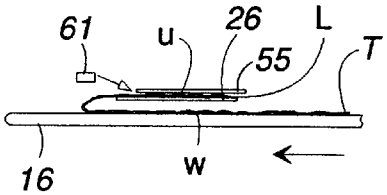
Figure 9F:
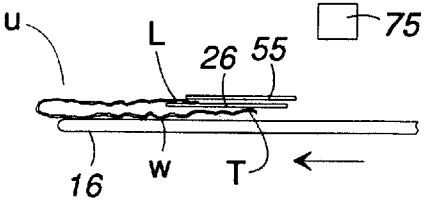

As the workpiece continues to move along the path of travel on conveyor 16, the leading edge portion of the workpiece is drawn further between folding plate 26 and clamping plate 55. After a pre-determined period of time has elapsed, the computer signals the lower cylinder 68 (FIG. 4B) of cylinder assembly 63 to lower the clamping plate into a partially open position above the folding plate, as shown in FIGS. 9C and 9D. This creates an aligning gap between the folding and clamping plates wherein the hemmed edges of the leading and trailing edge portions of the workpiece are urge against guide pins 92 (FIG. 4B) by the actuation of alignment air jets 97, 98, each of which directs a flow of air substantially parallel to the clamping and folding plates to urge the hemmed edges of the leading and trailing edge portions against the guide pins. After a further predetermined period of time during which a desired length or leading edge portion of the workpiece has been received between the folding and clamping plates, the upper cylinder 64 is actuated to move the clamping plate to its fully lowered, clamping position thereby pinching or holding the leading portion of the workpiece between the two plates, as illustrated in FIG. 9E. Thereafter, the computer emits a control signal to turn on the air flow or supply of pressurized air to the air plenum 44 of the folding plate 26, causing the folding plate to emit streams of air through ports 48 in the direction of the path of travel for the purpose of at least partially inflating at least a portion of the workpiece to separate the leading and trailing edge portions or upper and lower plies of the workpiece to assist in the folding process, as illustrated schematically in FIGS. 9E–F.

When the leading edge portion of the workpiece is clamped between the clamping and folding plates, the remainder or trailing edge portion of the workpiece continues to move along the path of travel beneath the folding plate. Generally, once the trailing edge T is detected by detector 75 (FIG. 9F), the computer signals the first transport clamp to clamp the sleeve and signals the upper cylinder 64 of cylinder assembly 63 (FIG. 3) to retract its cylinder rods and thus raise the clamping plate to its partially open position. At the same time, the alignment air jets 97, 98 are re-activated, as are airjets 61, at a lower flow to urge the hemmed edges of the leading and trailing edge portions of the workpiece against the guide pins to maintain the alignment of the hemmed edges of leading and trailing edge portions and to help smooth out wrinkles or curls as the leading edge portion is moved out from between the folding and clamping plates and matched with the trailing edge portion of the workpiece to complete the fold. In addition, as the leading edge portion of the workpiece is moved from between the folding and clamping plates, it passes over the beveled upstream edge 79 (FIGS. 4B and 5B) of separator blade 77. As a result, should any under-folds or curls be formed in the leading edge of the workpiece prior to clamping, such under-folds or curls will tend to be engaged and pulled or smoothed out by the engagement of the leading edge of the workpiece with the beveled upstream edge of the separator blade.

Figure 9G:
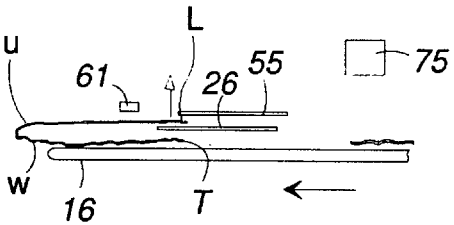
Figure 9H:
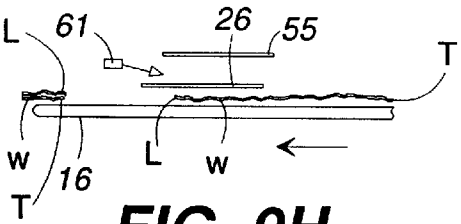

After the leading edge portion of the workpiece has been released, and the top and bottom portions of the hem have been aligned, the folded sleeve continues to move downstream on the hemming conveyor until it reaches surface transport table 125, illustrated in FIG. 2. As indicated in FIGS. 9G–H, as the leading edge L is pulled from between the clamping and folding plates, it is aligned and matched with the trailing edge T to complete the fold, and the drag exerted thereon by the plates tends to prevent wrinkles in or curling of the leading edge. In addition, as the leading edge portion of the workpiece is moved from between the plates, the operation of first air jets 61 at a lower flow rate (FIG. 3) at this time further helps eliminate any wrinkles in the workpiece during and after alignment of the hems.

Once at the transport table, the workpiece is engaged by clamp plate 114 (FIGS. 4A and 6A) of first transport clamp assembly 101. The two-way cylinder 108 receives a control signal from computer 190 to move the clamp plate into engagement with the upper portion of the workpiece, whereupon the computer signals two-way cylinder 102 to accelerate the workpiece away from the hemming conveyor, and to then decelerate the workpiece to a stop as it moves along the path of travel $P_1$ so that a lip or curl is not formed in the folded leading edge of the workpiece.

After the first transport clamp assembly 101 has moved the workpiece along the path of travel to a release position, but prior to clamp plate 114 releasing the workpiece, a clamp bar 162 (FIG. 4A) of a second transport clamp assembly 130, engages the workpiece after which the clamp plate 114 releases the workpiece. Thereafter, the computer emits a control signal to two-way rodless cylinder 131, which moves the workpiece along a second path of travel $P_2$ as the workpiece essentially follows a looped path back toward the operator's station 206 (FIG. 1).

As shown in FIG. 7, the second transport clamp assembly 130 is provided with transport clamp rotate assembly 137, so that, if desired, the transport clamp rotate assembly can at least partially rotate the hemmed and folded workpiece as it is moved along the surface of transport table toward seamer station 175 (FIG. 1). As indicated in FIG. 8, the workpiece is detected by upstream seamer detector 201 as it approaches the seamer station to activate the seamer station. The seamer station 175 engages the workpiece and moves the workpiece toward a seamer sewing head 176 (FIG. 1) for sewing a seam in the edges of the folded workpiece to finish the workpiece. As the workpiece is passed out of the seamer station along the path of travel $P_2$, it is detected by a downstream workpiece stacking station sensor 202 (FIG. 8) which notifies the computer of this fact, whereupon the computer 190 signals transfer plate 178 (FIG. 1) to pivotally drop the workpiece onto side conveyor 182.

The side conveyor 182 then moves the workpiece toward a stacking station and underneath a flip plate detector 203 (FIG. 8) which detects the presence of the workpiece on the flip plate and emits a detection signal to computer. In response, the computer emits the appropriate signal to the flip plate 183 (FIG. 1) so that the workpiece is flipped into bundle tray 184 positioned adjacent the operator's station 206 (FIG. 1). The machine operator may now visually inspect the finished workpiece, and may make adjustments in the machine as necessary, through touch screen 197 (FIG. 1) or the appropriate manual controls for correcting any discrepancies in the hem, the fold, or the seam. After a sufficient quantity of stacked workpieces is gathered in bundle tray 184, computer 190 emits a control signal to bundle tray indexing plate 186, which then pushes the workpieces toward a pusher assembly (not illustrated), which will transversely push the bundled workpieces onto bundle tray 187. Machine 5 thus allows for the automated production of a high quality finished workpiece accomplished quickly, and with a minimum of operator input such that a consistently sized quality finished workpiece is provided.

In a further embodiment of the present invention, if it is desired that the workpieces be folded to a consistent and pre-determined size, the computer will receive a leading edge detection signal from folding station detector 75 (FIG. 3) in response to the passage of the workpiece's leading edge beneath the detector. The computer then waits a predetermined period of time, i.e. a programmed period of time, before signaling the first transport clamp 114 to clamp the folded sleeve and the cylinder assembly 63 to release the leading edge portion, or upper ply, of the workpiece from between the clamping and folding plates such that the workpiece is folded to a pre-determined size, and not necessarily in half. So folded, this type of workpiece may need to have an extra portion of the leading or trailing edges, that may be present after folding, trimmed at the seamer station by a knife (not illustrated) provided as a part of the seamer station, such a knife being known in the art. Each workpiece so folded, however, will be identically sized during production. Thereafter the computer actuates air jets 61 to begin blowing in a direction opposite the path of travel in response to the detection of the leading edge of the workpiece, and the folding operation continues substantially as disclosed above.

It is further anticipated, although not illustrated specifically herein, that the control program held in EPROM 194 (FIG. 8) will include a programmed data table, or series of tables, stored in memory such that the operator can select and input desired control parameters from a displayed list of options through the data display/entry device. For example, the operator could specify whether the workpiece is folded to size, or folded in half.

While preferred embodiments of the invention have been disclosed in the foregoing specification, it is understood by those skilled in the art that variations and modifications thereof can be made without departing from the spirit and scope of the invention as set forth in the following claims. In addition, the corresponding structures, materials, acts, and equivalents of all means or step plus function elements in the claims are intended to include any structure, material, or acts for performing the functions in combination with other claimed elements, as specifically claimed herein.

APPENDIX

MACHINE OPERATING SEQUENCE

1 Machine operator turns on power

2 Machine electronics are initialized

3 Machine operator loads workpiece blank on conveyor and steps on start pedal

4 Hemmer conveyor moves sleeve toward hemming folder

5 Hemming folder detector sees leading edge of sleeve

6 Hemmer edge trimmer turns on

7 Hemming folder uncurl air tube starts blowing

8 Hemmer leading edge jet turns on briefly

9 Hemmer detector sees leading edge of workpiece

10 Hemmer sewing head starts

11 Chain vacuum turns on

12 Puller turns at chaining speed

13 Leading edge of workpiece reaches hemmer needles

14 Foot drops, tensioners on (close), conveyor turns at sync. speed

15 Puller turns at sewing speed

16 Just before leading edge of workpiece reaches knife:

knife cuts chain;

chain vacuum turns off

17 Folding station detector sees leading edge of workpiece, workpiece moves under folding plate on hemmer conveyor 18 Leading edge air jets turn on 19 Programmed timed delay 20 Clamping plate initially lowered to partially open position for aligning hemmed edges of workpiece 21 Aligning air jets turn on 22 Programmed timed delay 23 Clamping plate moved to fully lowered, clamped position 24 Leading edge air jets and aligning air jets turn off 25 Air supplied through folding plate to separate plies as trailing portion of workpiece continues to move 26 Hemming detector sees trailing edge of workpiece, trailing edge reaches hemming needles 27 Foot raises, tensioners off (open)

28 Puller turns at chaining speed

29 Programmed timed delay

30 Knife cuts chain

31 Chain vacuum turns on

32 Hemmer sewing head and chain vacuum turn off

33 Folding station detector sees trailing edge of workpiece

34 Air flows through folding plate shut off

35 First transport clamp engages workpiece

36 Clamping plate moves up to partially open position

37 Leading edge air jets turn on

38 Aligning air jets turn on

39 First transport clamp is accelerated away from folding station

40 Workpiece is pulled clear of alignment device

41 Clamping plate moved to raised, open position

42 Leading edge air jets and aligning air jets turn off

43 First transport clamp begins to decelerate

44 First transport clamp reaches end of travel

45 Hem clamp on second transport clamp extends

46 Second transport clamp engages workpiece

47 First transport clamp releases workpiece

48 First transport clamp returns home and deceleration is turned off

49 Second transport clamp moves along path of travel extending away from first path of travel, workpiece rotated to adjustable stop for alignment with seamer 50 Second transport clamp reaches end of travel 51 Seamer detector sees leading edge (hem) of workpiece 52 Hem clamp retracts 53 Seamer foot drops 54 Back latch vacuum turns on 55 Second transport clamp releases workpiece 56 Second transport clamp returns to home position 57 Side conveyor (seamer) moved toward workpiece 58 Seamer guide wheels engage workpiece from idle position 59 Programmed timed delay 60 Seamer guide wheels rotate to straight position 61 Side conveyor jog turns off (if on)

62 Seamer sewing head turns on, side conveyor on

63 Programmed timed delay

64 Back latch vacuum turns off

65 Seamer detector sees trailing edge of workpiece

66 Seamer guide wheels raise up

67 Seamer guide wheels rotate back to idle position

68 Trailing edge of workpiece reaches seamer needles

69 Untensioners open for minimal tension

70 Seamer waist venturi turns on

71 Programmed timed delay

72 Seamer sewing head turns off

73 Side conveyor jog turns on

74 Stacker conveyor turns on

75 Programmed timed delay

76 Back latch vacuum turns on

77 Seamer knife cuts stretched chain

78 Back latch vacuum turns off

79 Untensioners close for full thread tension

80 Side conveyor raises

81 Seamer waist venturi turns off

82 Workpiece stacking station detector sees leading edge (hem) of workpiece

83 Stacker transfer plate wheels drop, and plate drops

84 Workpiece stacking station detector sees folded edge of workpiece (trailing edge)

85 Stacker transfer wheels raise, and transfer plate raises flush with seamer

86 Flip door detector sees trailing (fold) edge of workpiece

87 Programmed timed delay

88 Flip door moved to place workpiece in bundle tray

89 Workpiece and bundle counts started/incremented

We claim:

1. A sewing apparatus for hemming, folding and seaming workpieces, each workpiece having a leading edge, a trailing edge and parallel side edges, as the workpieces are moved in series along a path of travel, comprising:

a folding station positioned along the path of travel of the workpieces;

a folding plate positioned at said folding station and having upstream and downstream ends;

said folding plate including a series of internally defined channels for directing a flow of air through said folding plate, and means for supplying the flow of air to said channels;

a clamping plate mounted above and reciprocably movable toward and away from said folding plate for engaging and clamping the leading edges of the workpieces between said folding and clamping plates; and means for creating a vacuum between said folding and clamping plates to draw the leading edges of the workpieces therebetween as the workpieces are passed beneath said folding plate;

wherein the workpieces are at least partially folded as the workpieces progress along the path of travel through said folding station.

2. The sewing apparatus of claim 1 and further including a detector for detecting the leading and trailing edges of the workpieces as the leading and trailing edges thereof move toward said folding station.

3. The sewing apparatus of claim 1 and wherein said means for creating a vacuum comprises a series of airjets positioned along a downstream edge of said clamping plate, with each air jet arranged to selectively direct a flow of air between said folding and clamping plates to create a vacuum between said plates.

4. The sewing apparatus of claim 1 and further including a means for selectively moving said clamping plate between a clamped position, a partially open position, and an open position with respect to said folding plate.

5. The sewing apparatus of claim 4 and wherein said means for moving said clamping plate comprises a first pneumatic cylinder connected to said clamping plate for moving said clamping plate between said clamped and said partially open positions, and a second pneumatic cylinder mounted above and connected to said first cylinder for moving said first cylinder and said clamping plate from said partially open position to said open position.

6. The sewing apparatus of claim 1 and wherein said folding plate includes an upper plate, and a lower plate having a series of ribs defining said channels for directing the flow of air through said folding plate, and with said means for supplying the flow of air including a plenum mounted to said upper plate and communicating with said channels.

7. The sewing apparatus of claim 1 and further including a hemming station positioned along the path of travel of the workpieces upstream of said folding station for hemming a side edge of each workpiece and a seaming station downstream of said folding station for forming a seam in the workpieces.

8. The sewing apparatus of claim 1 and further comprising a separator blade mounted to said folding plate and having a rear edge adapted to engage the leading edges of the workpieces as the leading edges are moved from between said folding and clamping plates to remove curls from the leading edges.

9. The sewing apparatus of claim 8 and wherein said separator blade further includes an internal air distribution channel for receiving and distributing a flow of air at least partially along said rear edge of said separator blade.

10. A method of folding a workpiece as the workpiece is conveyed along a path of travel, said method comprising:

moving the workpiece into a folding station;

as the workpiece enters the folding station, drawing a leading edge of the workpiece between a folding plate and a spaced clamping plate;

clamping a leading edge portion of the workpiece between the folding and clamping plates as a trailing edge portion of the workpiece is conveyed along the path of travel beneath the folding plate;

directing a flow of air through said folding plate and toward the workpiece as the workpiece continues to move beneath the folding plate and separating the leading and trailing edge portions of the workpiece in response thereto, thereby assisting in folding the workpiece; and releasing the leading edge portion of the workpiece onto the trailing edge portion of the workpiece to complete the folding of the workpiece.

11. The method of claim 10 and wherein the step of clamping the workpiece comprises the step of selectively moving the clamping plate from an open position to a clamped position with the workpiece engaged between the clamping plate and folding plate.

12. The method of claim 11 and wherein the step of moving the clamping plate to said clamped position includes the steps of moving the clamping plate to a partially open position after the leading edge has been partially drawn between the folding and clamping plates for aligning the edges of the workpiece in response thereto, and thereafter moving the clamping plate to its clamped position.

13. The method of claim 12 and further comprising the steps of activating at least one aligning jet when the clamping plate is in its partially open position, directing alignment air flows at side edges of the leading edge and trailing edge portions of the workpiece passing above and beneath the folding plate; and urging the side edges toward a guide means mounted along the path of travel to align the side edges of the leading edge and trailing edge portions of the workpiece.

14. The method of claim 13 and further including the steps of detecting the leading edge of the workpiece, and in response actuating air jets to create a vacuum between the folding and clamping plates.

15. The method of claim 10 and wherein the step of drawing the leading edge of the workpiece comprises the steps of creating a vacuum between the folding and clamping plates and drawing the leading edge of the workpiece over the folding plate and between the folding and clamping plates.

16. The method of claim 10 and wherein the step of directing a flow of air through the folding plate comprises the steps of supplying a flow of air to the folding plate, and directing the flow of air through a series of channels defined within the folding plate to distribute the air flow across at least a portion of the folding plate.

17. The method of claim 10 and further comprising:

moving a first transport clamp into engagement with the folded workpiece;

accelerating the workpiece away from the folding plate at a first rate of speed with said first transport clamp along the path of travel; and decelerating said first transport clamp and the workpiece to a second rate of speed less than said first rate of speed for preventing the collapse of the workpiece and the formation of a curl in the leading edge of the workpiece.

18. Apparatus for folding a workpiece, the workpiece having leading edge and trailing edge portions, and side edges, comprising:

a folding plate including an upstream edge, a downstream edge, and a plurality of internal chambers defined therein for receiving and distributing a flow of air across a series of ports extending at least partially along said downstream edge;

means for supplying air to said folding plate, mounted to said folding plate and communicating with said internal chambers; and a clamping plate movable into and out of engagement with said folding plate for clamping the leading edge portion of the workpiece therebetween;

whereby as the leading edge portion of the workpiece is received and clamped between said folding and clamping plates, said flow of air is directed through the folding plate at a portion of the workpiece to at least partially inflate the workpiece as the trailing edge portion passes below the folding plate to separate the leading edge and trailing edge portions of the workpiece, and assist in the folding of the workpiece.

19. The sewing apparatus of claim 18 and further including a means for selectively moving said clamping plate between a clamped position, a partially open position and an open position with respect to said folding plate.

20. The sewing apparatus of claim 19 and wherein said means for moving said clamping plate comprises a first pneumatic cylinder connected to said clamping plate for moving said clamping plate between said clamped and said partially open positions, and a second pneumatic cylinder mounted above and connected to said first cylinder for moving said first cylinder and said clamping platform from said partially open position into said open position.

21. The sewing apparatus of claim 18 and wherein said means for creating a vacuum comprises a series of air jets positioned along a downstream edge of said clamping plate, with each air jet arranged to selectively direct a flow of air between said folding and clamping plates to create a vacuum between said plates.

22. The sewing apparatus of claim 18 and further comprising a separator blade mounted to said folding plate and having an upstream edge adapted to engage the leading edge of the workpiece as the leading edge is moved from between said folding and clamping plates to remove curls from the leading edge.

23. The apparatus of claim 18 and further including at least one alignment air jet mounted with respect to said folding plate and constructed and arranged to direct a flow of air at a side edge of the leading edge and trailing edge portions of the workpiece to urge the side edges toward a guide for aligning the leading and trailing portions of the workpiece with one another as the workpiece is folded.

* * * * *